US009964889B2

(12) United States Patent
Sugano

(10) Patent No.: US 9,964,889 B2
(45) Date of Patent: May 8, 2018

(54) IMAGE FORMING APPARATUS THAT CONTROLS SUPPLY BIAS FOR SUPPLYING AND COLLECTING DEVELOPER

(71) Applicant: CANON KABUSHIKI KAISHA, Tokyo (JP)

(72) Inventor: Michio Sugano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/058,596

(22) Filed: Mar. 2, 2016

(65) Prior Publication Data

US 2016/0259265 A1 Sep. 8, 2016

(30) Foreign Application Priority Data

Mar. 6, 2015 (JP) ..... 2015-045086

(51) Int. Cl.
*G03G 15/06* (2006.01)
*G03G 15/00* (2006.01)

(52) U.S. Cl.
CPC ..... *G03G 15/065* (2013.01); *G03G 15/50* (2013.01)

(58) Field of Classification Search
CPC ..... G03G 15/065; G03G 15/0808; G03G 15/0832; G03G 15/0822; G03G 15/0865; G03G 2215/0465
See application file for complete search history.

(56) References Cited

U.S. PATENT DOCUMENTS 5,826,144 A 10/1998 Takenaka et al.
9,411,258 B1 * 8/2016 Ishii ..... G03G 15/043
2009/0297192 A1 * 12/2009 Matsuzaki ..... G03G 15/065 399/55

FOREIGN PATENT DOCUMENTS

JP 09-015976 A 1/1997
JP 09-073217 A 3/1997
JP 2003-084565 A 3/2003
JP 2014-164038 A 9/2014

* cited by examiner

*Primary Examiner* — Sevan A Aydin
(74) *Attorney, Agent, or Firm* — Fitzpatrick, Cella, Harper, & Scinto

(57) ABSTRACT

An image forming apparatus includes: a development unit configured to develop, using a developer, the electrostatic latent image formed on an image carrier and form a developer image in a region where the image carrier faces the development unit; a supply unit configured to output a supply bias, supply the developer to the development unit, and collect the developer from the development unit; a reception unit configured to receive image data; an analysis unit configured to analyze a non-image region where the developer image is not formed from the image data; and a control unit configured to control the supply bias in accordance with a length of the non-image region where the developer image is not formed in a rotation direction of the image carrier.

19 Claims, 19 Drawing Sheets

FIG. 7

| DENSITY Dc | CORRECTION COEFFICIENT $\alpha$ |
|---|---|
| $0 < Dc \leq 10$ | 0.1 |
| $10 < Dc \leq 20$ | 0.2 |
| $20 < Dc \leq 30$ | 0.3 |
| $30 < Dc \leq 40$ | 0.4 |
| $40 < Dc \leq 50$ | 0.5 |
| $50 < Dc \leq 60$ | 0.6 |
| $60 < Dc \leq 70$ | 0.7 |
| $70 < Dc \leq 80$ | 0.8 |
| $80 < Dc \leq 90$ | 0.9 |
| $90 < Dc < 100$ | 1.0 |

IMAGE FORMING APPARATUS THAT CONTROLS SUPPLY BIAS FOR SUPPLYING AND COLLECTING DEVELOPER

BACKGROUND OF THE INVENTION

1. Field of the Invention

The present invention relates to image forming apparatuses such as copying machines and laser printers.

2. Description of the Related Art

There are kinds of image forming apparatuses in which an electrostatic latent image is formed on a photosensitive member, a development unit develops the electrostatic latent image using toner to form a toner image, and the toner image is transferred and fixed to a recording medium, thereby forming an image. The development unit has a supply roller and a development roller, and the toner is charged due to friction as a result of mechanical frictional sliding of the supply roller and the development roller. The charged toner is supplied to the development roller, and is supplied to the electrostatic latent image on the photosensitive member.

The toner that is not transferred to the photosensitive member and remains on the development roller is affected by a development bias applied by the development roller, and the amount of charge thereof increases. If the electrostatic latent image on the photosensitive member is developed by the toner with the increased amount of charge, the amount of toner attached to the electrostatic latent image becomes smaller than a target amount, resulting in a low density. Since the amount of charge of the toner increases proportionally to the time during which the toner remains on the development roller, for example, if a solid image is printed after a long blank space, a state where the density is low in an area corresponding to one rotation of the development roller from the leading end of the solid image occurs in some cases. Note that, in the following description, a phenomenon in which the image density lowers due to an increase in the amount of charge of the toner will be called a "development ghost".

Japanese Patent Laid-Open No. 9-15976 discloses a configuration in which the supply of the toner from the supply roller to the development roller and the collection of the toner from the development roller to the supply roller are performed using electrostatic force, and an increase in the amount of charge of the toner due to the toner remaining on the development roller for a long time is suppressed. Processing for collecting the toner on the development roller will be hereinafter called "toner collection processing".

Conventionally, the toner collection processing is performed in a time period between image formation on recording mediums. Here, in order to suppress generation of a development ghost, the toner collection processing needs to be executed for one rotation of the development roller. Accordingly, for example, assuming that the length of an interval between successive recording mediums (hereinafter called a "sheet interval") is larger than or equal to the circumference of the development roller, downtime may possibly occur, and therefore, execution of the toner collection processing within an appropriate time period is desired.

SUMMARY OF THE INVENTION

According to an aspect of the present invention, an image forming apparatus includes: an image carrier configured to be driven to rotate and on which an electrostatic latent image is to be formed; a development unit configured to develop, using a developer, the electrostatic latent image formed on the image carrier and form a developer image in a region where the image carrier faces the development unit; a supply unit configured to output a supply bias, supply the developer to the development unit, and collect the developer from the development unit; a reception unit configured to receive image data; an analysis unit configured to analyze a non-image region where the developer image is not formed from the image data; and a control unit configured to control the supply bias in accordance with a length of the non-image region where the developer image is not formed in a rotation direction of the image carrier.

Further features of the present invention will become apparent from the following description of exemplary embodiments with reference to the attached drawings.

BRIEF DESCRIPTION OF THE DRAWINGS

FIG. 7 is an illustrative diagram of a method for determining a correction coefficient according to an embodiment.

DESCRIPTION OF THE EMBODIMENTS

Hereinafter, exemplary embodiments of the present invention will be described with reference to the drawings. Note that the following embodiments are examples, and are not intended to limit the present invention to the content of the embodiments. Constituent elements that are not necessary for the description of the embodiments are omitted in the diagrams used below.

First Embodiment

Figure 1:
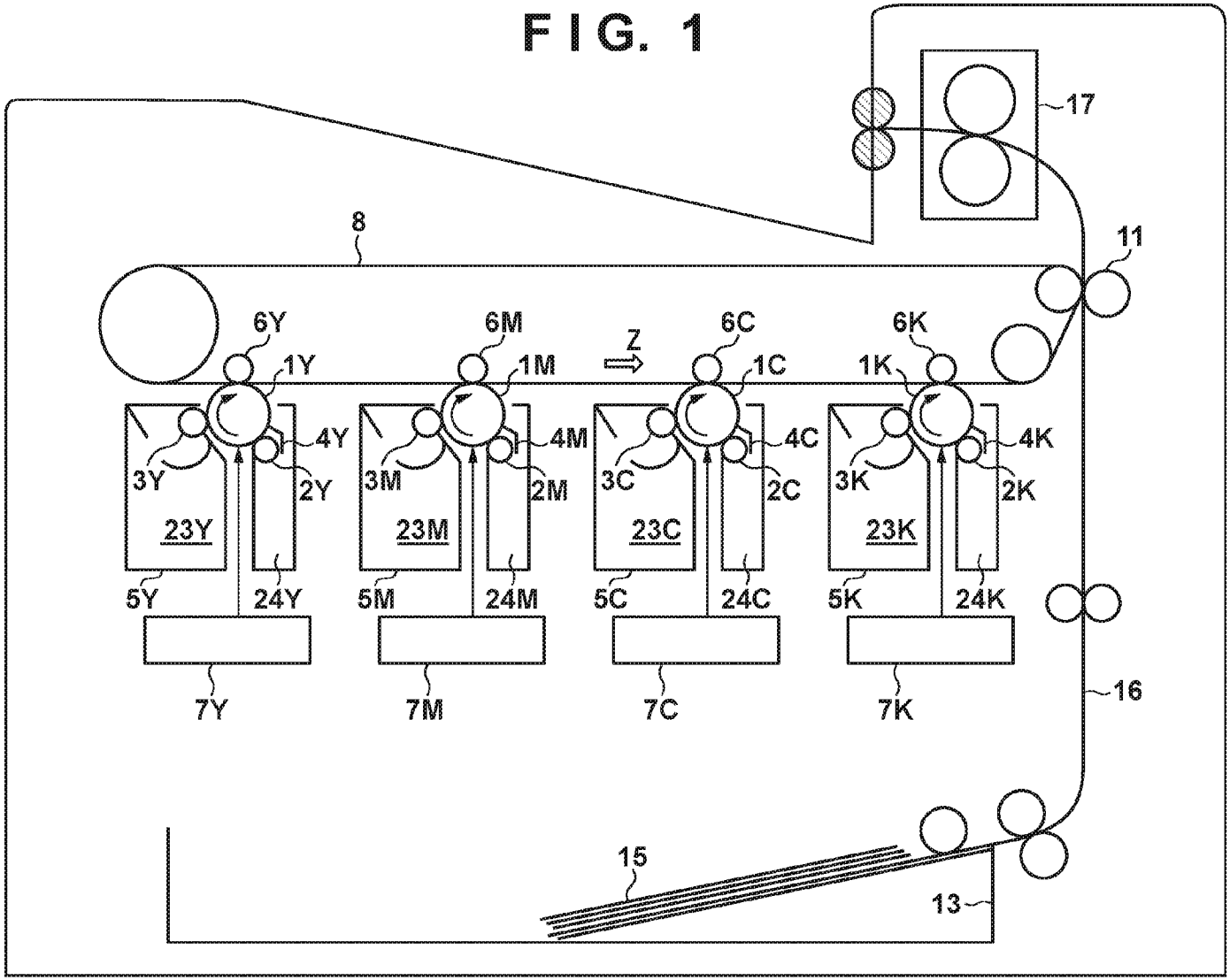
FIG. 1 is a diagram showing a configuration of an image forming apparatus according to an embodiment.

FIG. 1 is a diagram showing a configuration of an image forming apparatus according to the present embodiment.

Note that alphabetic characters Y, M, C, and K at the end of reference numerals indicate that colors of toner images that are formed by members denoted by these reference numerals are yellow (Y), magenta (M), cyan (C), and black (K), respectively. Note that the following description will use reference numerals without the alphabetic characters Y, M, C, and K at the end in the case where the toner colors do not need to be distinguished. The image forming apparatus has process cartridges 5 that can be attached to and detached from the image forming apparatus. The process cartridges 5 each include a toner container 23, a photosensitive member 1, which is an image carrier, a charging roller 2, a development unit including a development roller 3, a cleaning blade 4, and a waste toner container 24.

When forming an image, each photosensitive member 1 is driven to rotate in the direction of an arrow indicated at the photosensitive member 1 in the diagram. The charging roller 2 outputs a negative charging bias and charges the surface of the photosensitive member 1 at a uniform potential. The exposure unit 7 exposes the surface of the photosensitive member 1 to the light that corresponds to an image to be formed, and forms an electrostatic latent image on the photosensitive member 1. The development roller 3 outputs a development bias, and develops the electrostatic latent image on the photosensitive member 1 in a region where the development roller 3 faces the photosensitive member 1 using toner (developer) contained in the toner container 23 to visualize the electrostatic latent image as a toner image (developer image). A primary transfer roller 6 outputs a primary transfer bias, and transfers the toner image on the photosensitive member 1 to an intermediate transfer member 8. Note that a multicolor toner image is formed by transferring toner images on the photosensitive members 1Y, 1M, 1C, and 1K to the intermediate transfer member 8 overlappingly. The toner that is not transferred to the intermediate transfer member 8 and remains on the photosensitive member 1 is collected into the waste toner container 24 by the cleaning blade 4.

The intermediate transfer member 8, which is an image carrier, is stretched by three rollers, and is driven to rotate in the direction of an arrow Z in the diagram. Accordingly, the toner image transferred to the intermediate transfer member 8 is conveyed to a position at which secondary transfer roller 11 faces by the rotation of the intermediate transfer member 8. Meanwhile, a recording medium 15 in a feed cassette 13 is conveyed along a conveyance path 16 to the position at which the secondary transfer roller 11 faces. Note that the recording medium 15 is conveyed by rollers provided along the conveyance path 16. The secondary transfer roller 11 outputs a secondary transfer bias and transfers the toner image on the intermediate transfer member 8 to the recording medium 15. The recording medium 15 is thereafter conveyed to a fixing unit 17. The fixing unit 17 heats and presses the recording medium 15 and fixes the toner image to the recording medium 15. After the fixation of the toner image, the recording medium 15 is discharged to the outside of the image forming apparatus.

Figure 2:
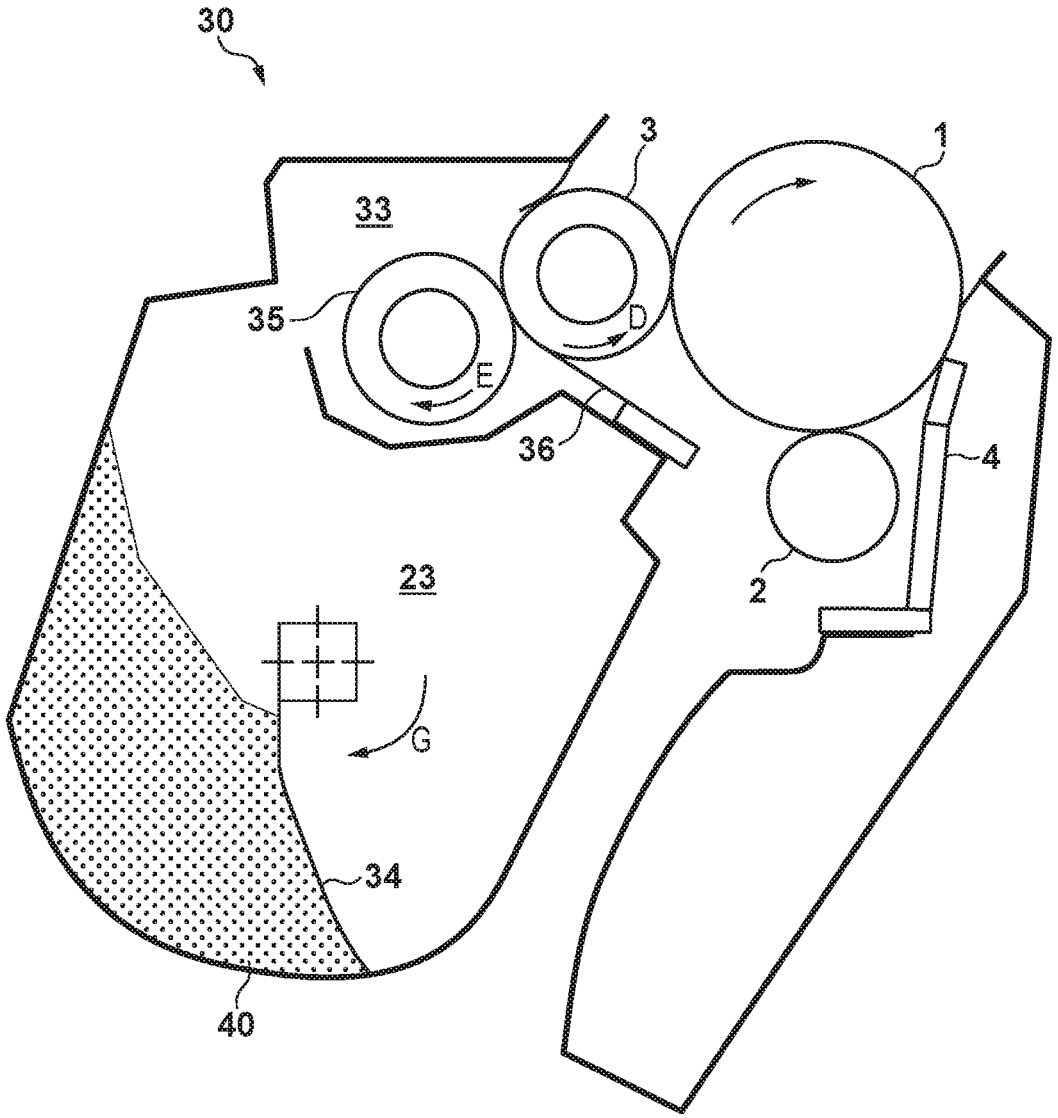
FIG. 2 is a diagram showing a configuration of a development unit according to an embodiment.

FIG. 2 shows the details of the process cartridges 5. The development unit 30 has a development chamber 33 and the toner container 23. Toner 40 is contained in the toner container 23. The toner container 23 is also provided with a conveyance member 34 for conveying the toner 40 to the development chamber 33. The conveyance member 34 is driven to rotate in the direction of an arrow G in the diagram, thereby conveying the toner 40 to the development chamber 33. The development chamber 33 is provided with the development roller 3 that comes into contact with the photosensitive member 1 and is driven to rotate in the direction of an arrow D in the diagram. The development roller 3 outputs a development bias applied from a development bias application unit (not shown). Furthermore, the development chamber 33 is provided with a supply roller 35 for supplying the toner 40 conveyed from the toner container 23 to the development roller 3, and a restriction member 36 for restricting the amount of the toner 40 on the development roller 3 and charges the toner 40. The supply roller 35 is in contact with the development roller 3 in a region where the supply roller 35 faces the development roller 3, and is driven to rotate in the direction of an arrow E in the diagram. A supply bias is applied to the supply roller 35 from a supply bias application unit (not shown). The force in the direction toward the development roller 3 or the force in the direction toward the supply roller 35 is exerted on the toner 40 in accordance with a potential difference between the supply bias and the development bias. The toner 40 supplied to the development roller 3 by the supply roller 35 proceeds to a contact portion between the restriction member 36 and the development roller 3 by the rotation of the development roller 3. The toner 40 is charged due to friction as a result of frictional sliding of the surface of the development roller 3 and the restriction member 36, and the layer thickness of the toner 40 is restricted. The charged toner 40 is conveyed to the region where the development roller 3 faces the photosensitive member 1 by the rotation of the development roller 3, and is attached to the electrostatic latent image on the photosensitive member 1 in this facing region.

Figure 3:
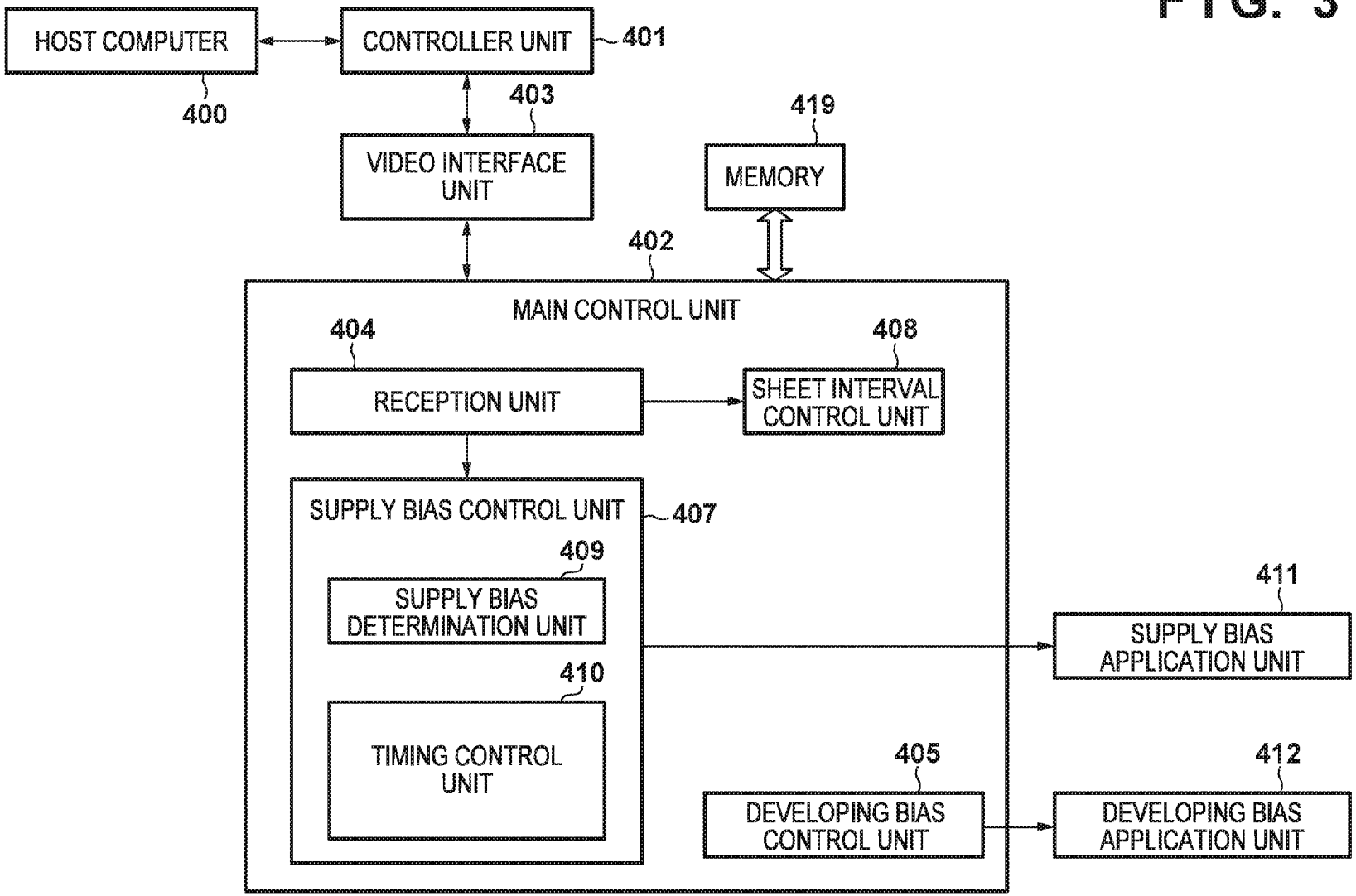
FIG. 3 is a diagram showing a control configuration of the image forming apparatus according to an embodiment.

FIG. 3 is a diagram showing a control configuration of the image forming apparatus according to the present embodiment. A controller unit 401 receives an image signal that indicates image information and print conditions from an external host computer 400. The controller unit 401 extracts an image from the image information in the image signal received from the host computer 400, and transmits the extracted image as print information to a main control unit 402 via a video interface unit 403. The print information according to the present embodiment includes density information regarding the toner image transferred to the recording medium 15. Note that a region having a toner density of 0% in the density information, i.e., a region where the toner image is not formed, can be called a non-image region. In other words, it can be said that a blank space in which an image is not formed is included in the non-image region. The density information also includes information about the non-image region (hereinafter also referred to as blank space information).

A reception unit 404 in the main control unit 402 receives the density information transmitted by the controller unit 401, and notifies a supply bias control unit 407 and a sheet interval control unit 408 of the received density information. The supply bias control unit 407 has a supply bias determination unit 409 and a timing control unit 410, and controls a supply bias application unit 411 that outputs a supply bias to the supply roller 35. The timing control unit 410 determines a timing of changing the supply bias. The sheet interval control unit 408 determines a sheet interval using the density information to control the sheet interval. Note that the sheet interval is an interval between a leading recording medium and a recording medium that follows the leading recording medium when an image is formed on a plurality of recording mediums. The development bias control unit 405 controls a development bias application unit 412 that outputs a development bias to the development roller 3. A memory 419 is a storage unit. Note that, in the present embodiment, the memory 419 does not refer to a single memory device but is a collective name of one or more memory devices in the image forming apparatus, and includes a volatile memory, a nonvolatile memory, or the like. A program executed by the main control unit 402 and various data used in the control by the main control unit 402 are stored in the memory 419.

A development ghost occurs as a result of the amount of charge of the toner 40 changing on the development roller 3. Specifically, while forming a blank space, the amount of charge of the toner 40 on the development roller 3 increases proportionally to the time. As a result of the increase in the amount of charge, the amount of the toner 40 to be attached to the electrostatic latent image on the photosensitive member 1 decreases. For example, if a blank space forming period is longer than or equal to a cycle of the development roller 3, the amount of charge of the toner 40 attached to the circumferential surface of the development roller 3 increases. As a result, if a solid image is thereafter formed, the density of the toner image lowers until all of the toner 40 whose amount of charge has increased on the development roller 3 is supplied to the electrostatic latent image on the photosensitive member 1.

Figure 4:
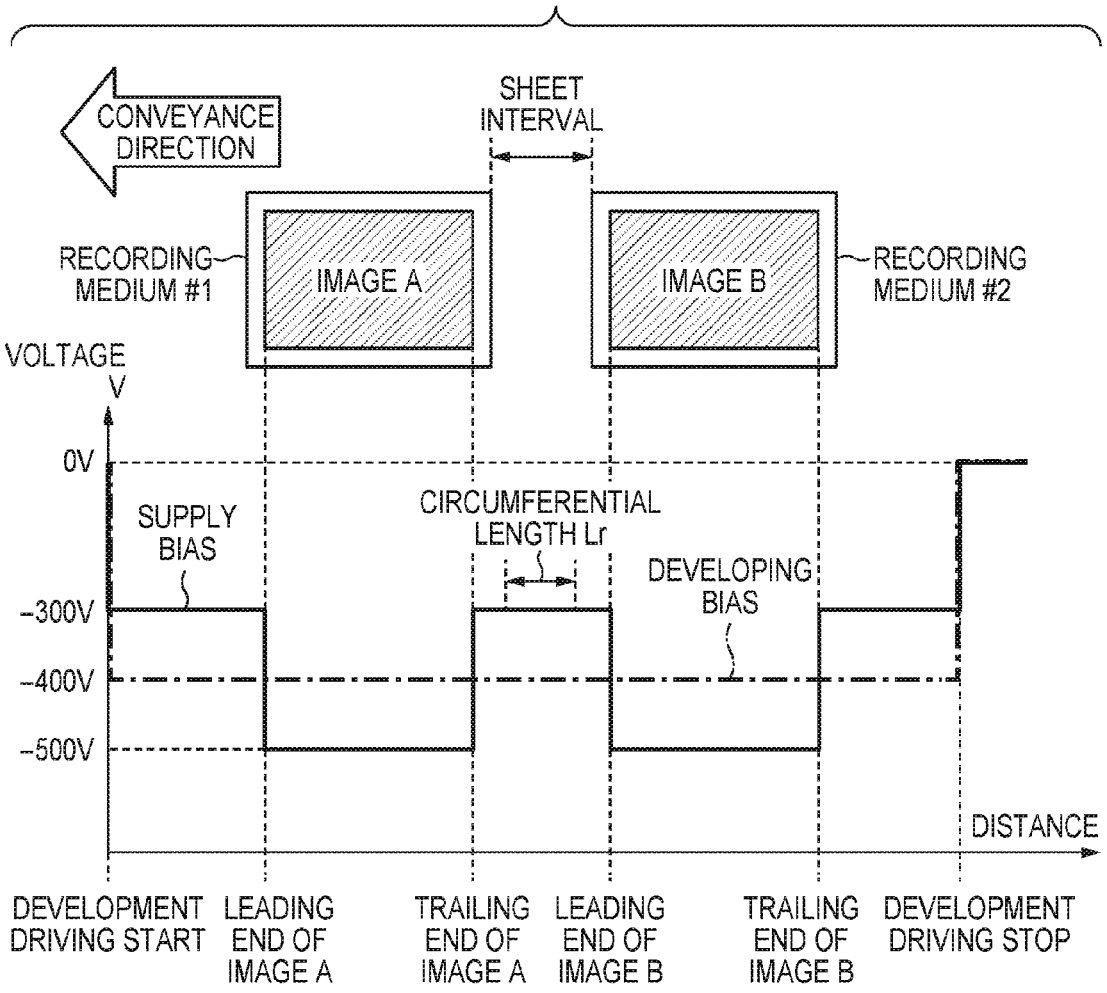
FIG. 4 is an illustrative diagram of bias control according to an embodiment.

Bias control of the development roller 3 and the supply roller 35 according to the present embodiment will be described below. FIG. 4 is an illustrative diagram of the bias control in the case of successively forming images on two recording mediums. Note that, in FIG. 4, the horizontal axis indicates the distance, and the vertical axis indicates the development bias and the supply bias of the development roller 3 and the supply roller 35. Note that although the value on the horizontal axis in FIG. 4 actually indicates the time, this value is converted into the distance that is based on the recording medium conveyance speed in order to describe a relationship with a sheet interval. In FIG. 4, it is assumed that the distance from the trailing end of an image A which is to be formed on a recording medium #1 to the leading end of an image B which is to be formed on a recording medium #2 is longer than the circumferential length Lr of the development roller 3. Note that, in the following description, the leading end and the trailing end mean the leading end and the trailing end in a recording medium conveyance direction, and the length and the distance mean the length and the distance in the recording medium conveyance direction. Furthermore, the circumferential length Lr of the development roller 3 will be simply called the circumferential length Lr.

In the present embodiment, the development bias is a constant value from "development driving start" to "development driving stop", and is −400 V in the example in FIG. 4. On the other hand, while toner images corresponding to the image A and the image B are being formed on the photosensitive member 1, the supply bias is set to −500 V. By setting the supply bias lower than the development bias, the force in the direction toward the development roller 3 is exerted on the toner 40, and the toner 40 is supplied to the development roller 3. On the other hand, the supply bias is set to −300 V from "development driving start" to "leading end of image A" on the recording medium #1, from "trailing end of image A" to "leading end of image B", and from "trailing end of image B" on the recording medium #2 to "development driving stop". By setting the supply bias higher than the development bias, the force in the direction toward the supply roller 35 is exerted on the toner 40, and the toner collection processing is thereby executed. Accordingly, the toner 40 on the development roller 3 can be collected to suppress an increase in the amount of charge of the toner 40. Note that, in FIG. 4, the timing of setting the supply bias to −300 V or −500 V is, in practice, the timing of developing the image A or the image B on the photosensitive member 1. Specifically, in FIG. 4, the supply bias is set to −300 V from the trailing end of the image A to the leading end of the image B. This means that the supply bias is set to −300 V from when the trailing end of the image A is developed on the photosensitive member 1 until the leading end of the image B starts to be developed on the photosensitive member 1. That is to say, in FIG. 4, the supply bias is set to −500 V while positions of the photosensitive member 1 that correspond to the images to be formed on the recording mediums are passing through the region where the photosensitive member 1 faces the development roller 3. Also, in FIG. 4, the supply bias is set to −300 V while positions of the photosensitive member 1 that correspond to the sheet interval and the blank space on the recording mediums are passing through the region where the photosensitive member 1 faces the development roller 3. The relationship between the expression in this diagram and the timing of setting the supply bias is also the same in the subsequent diagrams that are similar to FIG. 4.

Here, for the sake of simplification of the description, the supply bias is switched with the end portions of the image A and the image B as references. However, in the actual operations of the image forming apparatus, a predetermined time period T in which the toner 40 moves from a nip portion between the development roller 3 and the supply roller 35 to a nip portion between the development roller 3 and the photosensitive drum 1 is required until the toner 40 is supplied to the photosensitive member 1 and an electrostatic latent image is developed as an image. Accordingly, in the control in the actual image forming apparatus, the timing of switching the supply bias is a timing that is the predetermined time period T earlier than the timing that corresponds to each of the aforementioned end portions of the images. Note that this predetermined time period T can be obtained based on the following equation.

$$\text{Predetermined time period } T=L/V$$

Here, L denotes the distance from the nip portion between the development roller 3 and the supply roller 35 to the nip portion between the development roller 3 and the photosensitive member 1 in the rotation direction of the development roller 3. V denotes the rotation speed of the development roller 3. Accordingly, the aforementioned timing of switching the supply bias can be rephrased as setting the supply bias to −300 V from the timing that is the predetermined time period T earlier than when developing the trailing end of the image A on the photosensitive member 1 until the timing that is the predetermined time period T earlier than when starting to develop the leading end of the image B on the photosensitive member 1. Also, the aforementioned timing of switching the supply bias can be rephrased as setting the supply bias to −500 V from the timing that is the predetermined time period T earlier than when the position of the photosensitive member 1 that corresponds to the leading end of an image to be formed on a recording medium starts to pass through the region where the photosensitive member 1 faces the development roller 3 until the timing that is the predetermined time period T earlier than when the position of the photosensitive member 1 that corresponds to the trailing end of the image to be formed on the recording medium finishes passing through the region where the photosensitive member 1 faces the development roller 3. Furthermore, the aforementioned timing of switching the supply bias can also be rephrased as setting the supply bias to −300 V from the timing that is the predetermined time period T earlier than when the position of the photosensitive member 1 that corresponds to the leading end of a region including a sheet interval and blank spaces on recording mediums starts to pass through the region where the photosensitive member 1 faces the development roller 3 until the timing that is the predetermined time period T earlier than when the position of the photosensitive member 1 that corresponds to the trailing end of the region including the sheet interval and the blank spaces on the recording mediums finishes passing through the region where the photosensitive member 1 faces the development roller 3. Descriptions of this predetermined time period T will be omitted below in order to avoid complication of the description.

FIGS. 5A, 5B, 6A, and 6B are illustrative diagrams of the bias control according to the present embodiment. In FIGS. 5A, 5B, 6A, and 6B, it is assumed that the toner density in the recording medium conveyance direction is uniform. Note that, although the description will be given here while taking formation of a yellow image as an example, the same control can be performed for the colors of magenta, cyan, and black. Note that, in the following description, the development bias is denoted by Gv, the supply bias at the time of the toner collection processing is denoted by Rh, and the supply bias for supplying the toner to the development roller 3 is denoted by Rv. For example, in the example in FIG. 4, Gv=−400 V, Rh=−300 V, and Rv=−500 V.

Figure 5A:
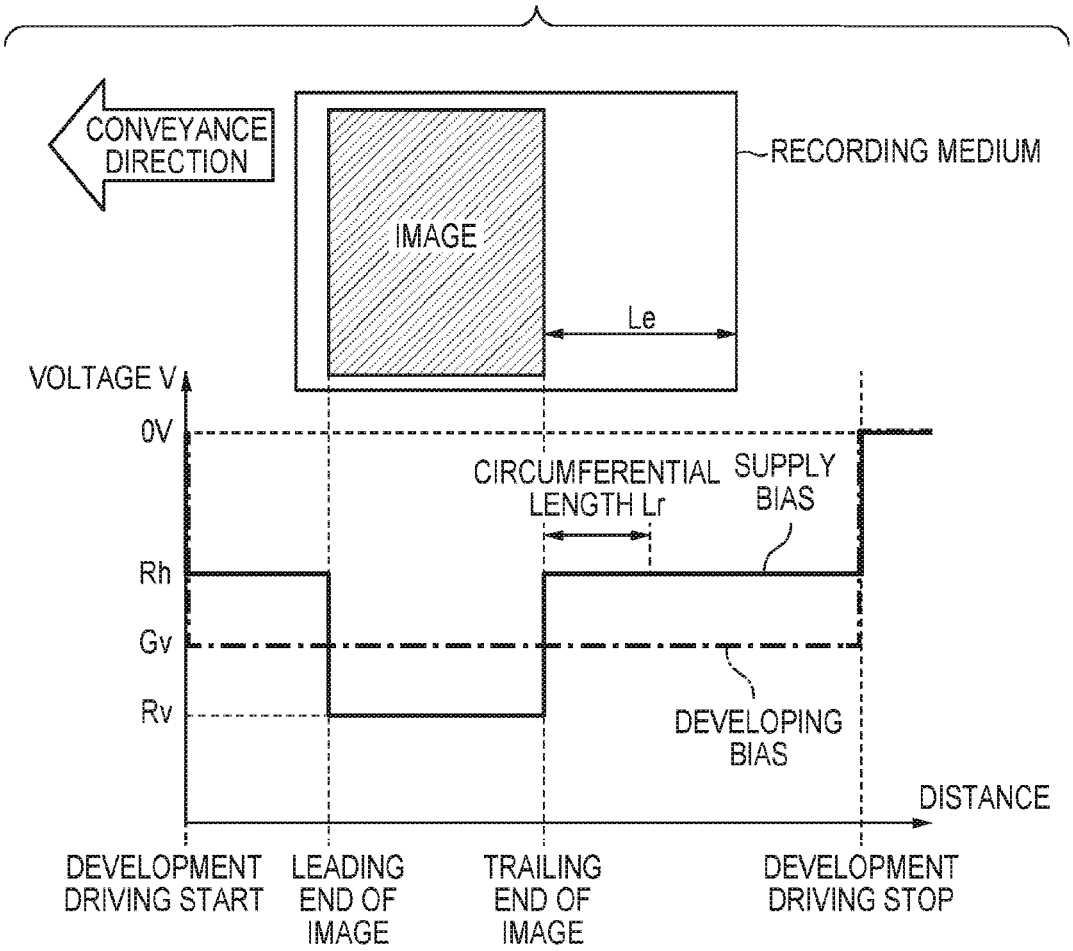
FIGS. 5A and 5B are illustrative diagrams of the bias control according to an embodiment.
Figure 5B:
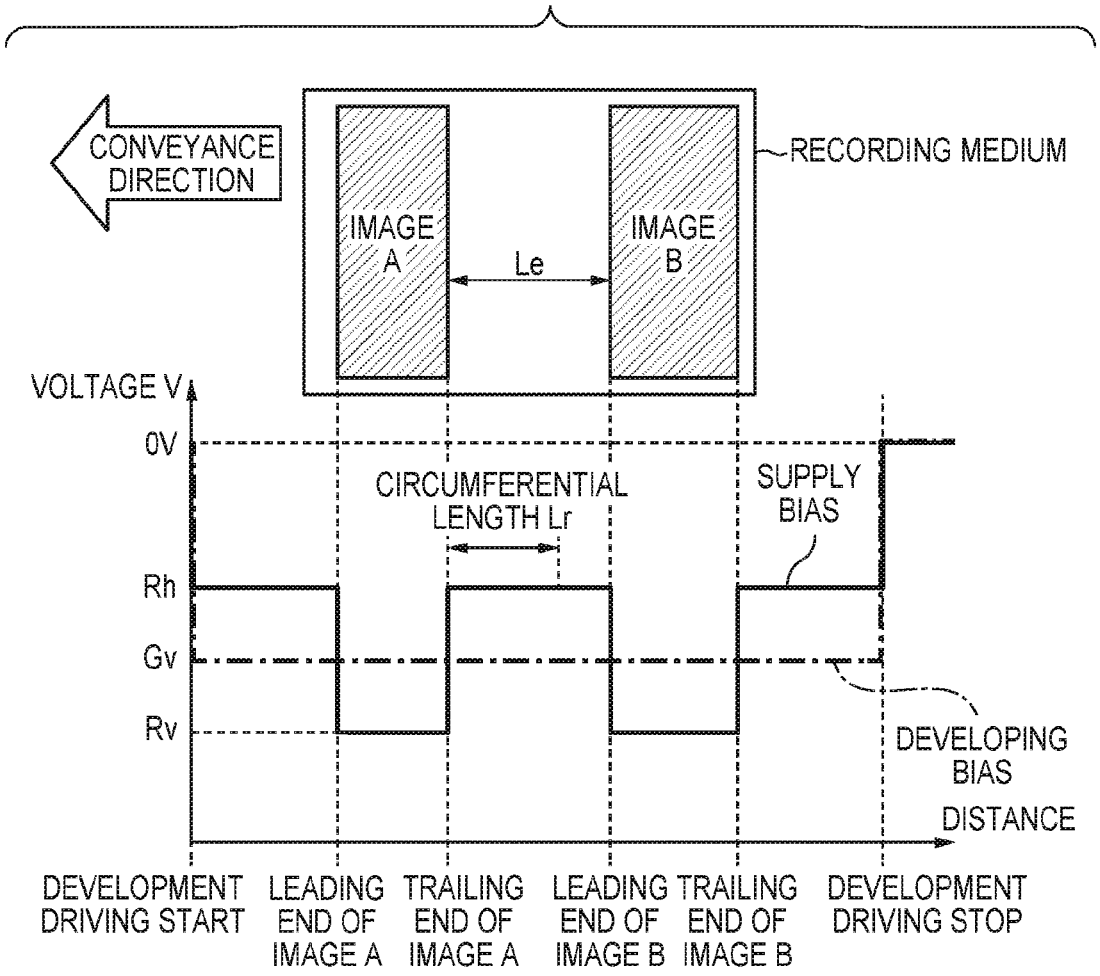

FIG. 5A shows the case where the length Le of a blank space at the trailing end of an image on a recording medium, i.e., the non-image region, is larger than or equal to the circumferential length Lr of the development roller 3. If the length Le of the non-image region is larger than or equal to a predetermined length, i.e., larger than or equal to the circumferential length Lr, the main control unit 402 performs the toner collection processing from the start of the blank space until the driving of the development unit stops, i.e., from the trailing end of the image until the driving of the development unit 30 stops. FIG. 5B shows the case where the length Le of the blank space between the image A and the image B is larger than or equal to the circumferential length Lr of the development roller 3. In this case, the main control unit 402 performs the toner collection processing from the start of the blank space (trailing end of the image A) until the end of the blank space (leading end of the image B).

Figure 6A:
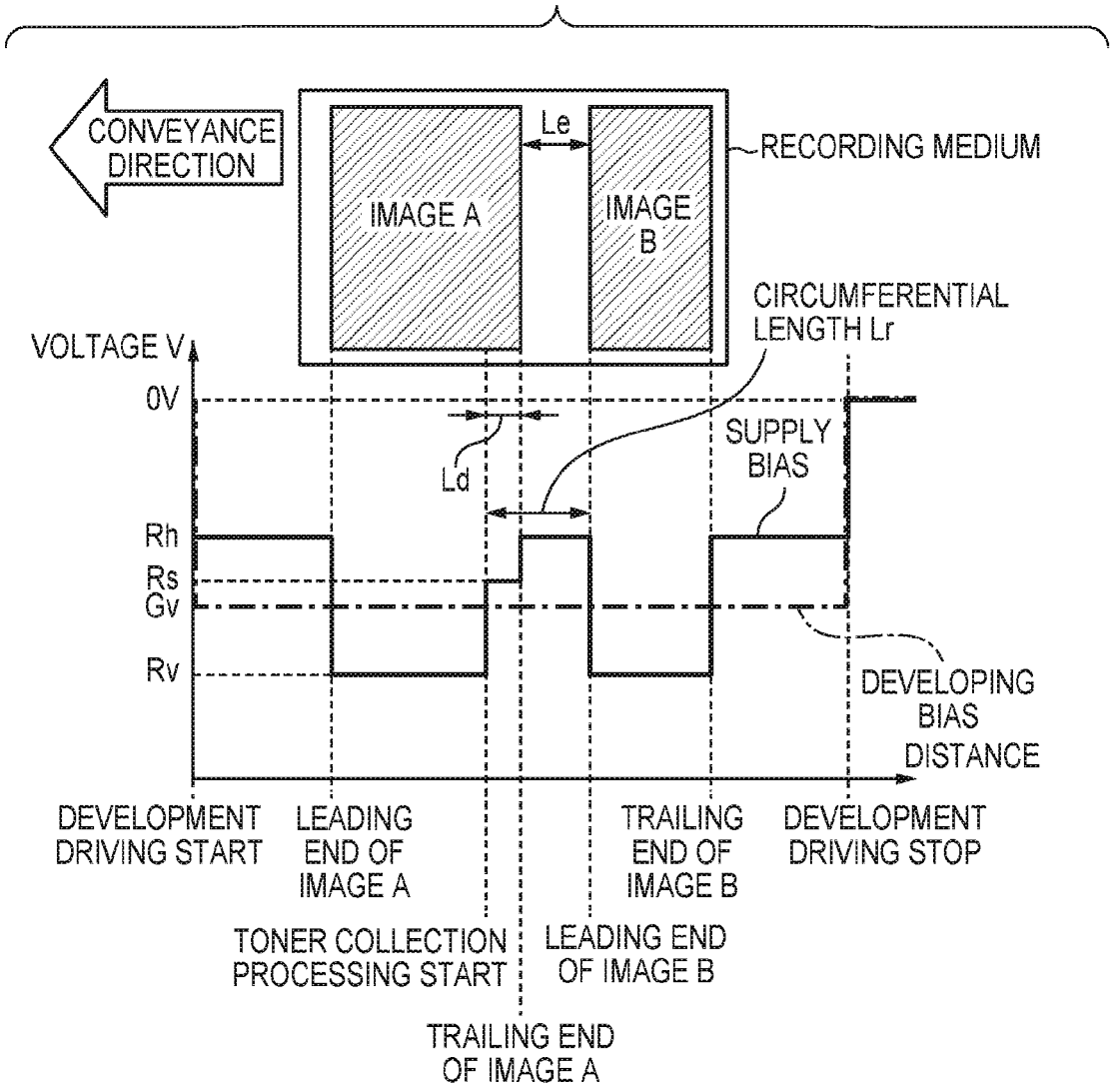
FIGS. 6A and 6B are illustrative diagrams of the bias control according to an embodiment.

FIG. 6A shows the case where the length Le of the blank space between the image A and the image B within a recording medium is smaller than the circumferential length Lr of the development roller 3, and the toner density Dc of the image A is smaller than a threshold value. Note that although the toner density Dc is uniform in the present embodiment, if the toner density Dc changes, a largest value, an average value, a smallest value, or the like is used as the toner density Dc, for example. In this case, the main control unit 402 obtains a length Ld, which is a length obtained by subtracting the length Le of the blank space from the circumferential length Lr, sets a section that extends from the trailing end of the image A in the direction toward the leading end and has the length Ld as a section Ld, and obtains the density in the section Ld from the density information. Note that if the density in the section Ld changes, a largest value, an average value, a smallest value, or the like is used as the density in the section Ld. The main control unit 402 obtains the supply bias Rs in the section Ld based on the density in the section Ld using Equation (1) below.

$$Rs=Rh-(|Gv-Rh|\times\alpha) \quad (1)$$

Here, α is a correction coefficient whose value is larger than 0, and is equal to or smaller than 1, in accordance with the density in the section Ld. Note that the correction coefficient α can be set so as to be larger as the density in the section Ld is larger, for example. This is because, if the density is high, unevenness in the density in the image becomes more remarkable as the supply bias is closer to the value Rh at the time of executing the toner collection processing.

The correction coefficient α can be obtained as a function of a threshold Th and a density Dld in the section Ld, as indicated by Expression (2).

$$\alpha=Dld/Th \quad 0<Dld<Th \quad (2)$$

A configuration may also be employed in which information indicating a relationship between the density Dc and the correction coefficient α such as the information as shown in FIG. 7 is stored in advance in the memory 419, and the correction coefficient α is obtained using this information. Note that, in FIG. 7, the threshold is 100. Returning to FIG. 6A, the main control unit 402 sets the supply bias to Rs in the section Ld, and thereafter sets the supply bias to Rh from the trailing end of the image A to the leading end of the image B. Note that the toner collection processing is also executed in the section Ld based on Equation (1). However, the difference between the supply bias Rs and the development bias Gv is smaller than the difference between the supply bias Rh and the development bias Gv except in the case where the correction coefficient α is 0. Accordingly, the force in the direction toward the supply roller 35 that is exerted on the toner in the section Ld is smaller than on a sheet interval.

Figure 6B:
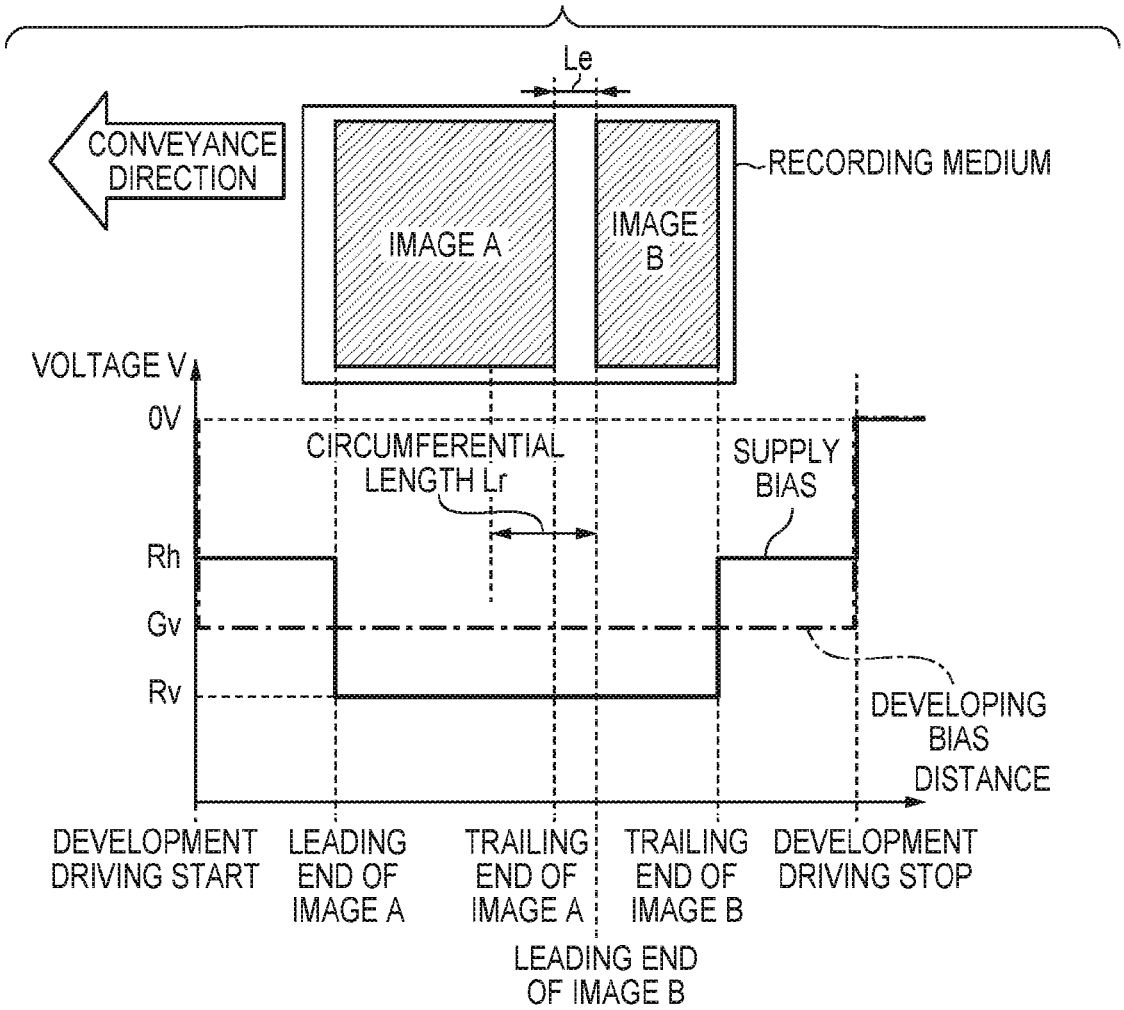

FIG. 6B shows the case where the length Le of the blank space from the image A to the image B is smaller than the circumferential length Lr of the development roller 3, and the density Dc of the image A is larger than or equal to the threshold value. In this case, the toner collection processing is not performed in the blank space region, and accordingly, the supply bias is also set to Rv for the blank space. This is because, if the toner density of the image A is larger than or equal to the threshold value, the amount of the toner whose amount of charge changes is small after developing the trailing end of the image A since the amount of the toner remaining on the development roller 3 is small and the time period between the images is short. That is to say, this is because a development ghost is not easily generated in the image B.

Figure 8:
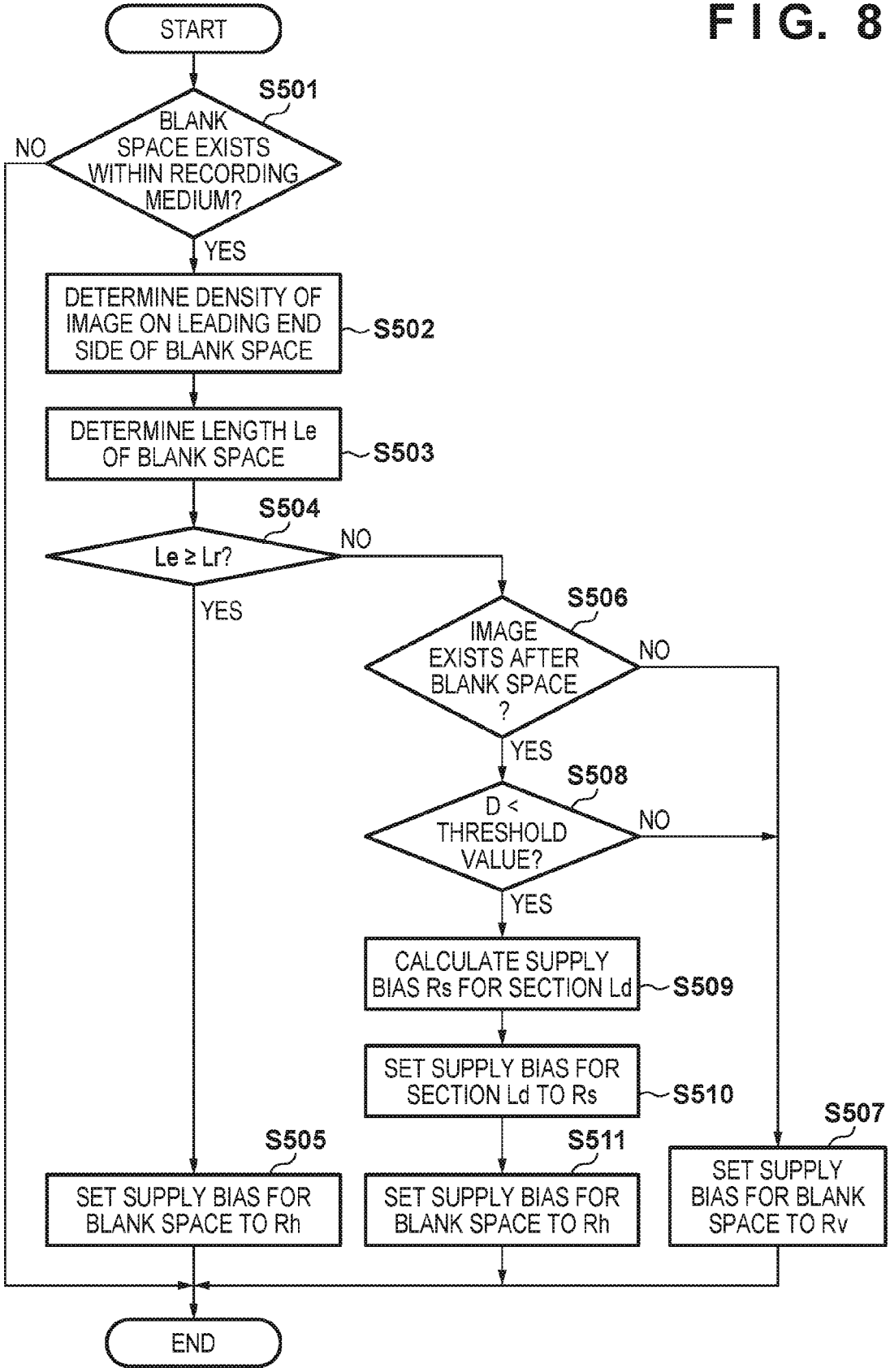
FIG. 8 is a flowchart of the bias control according to an embodiment.

FIG. 8 is a flowchart of processing in the main control unit 402. In step S501, the main control unit 402 determines whether or not a blank space exists within a recording medium. If a blank space does not exist, the main control unit 402 determines that the toner collection processing is not necessary, and ends the processing. On the other hand, if a blank space exists, in step S502, the main control unit 402 determines the density D of an image located on the leading end side of the blank space. Furthermore, in step S503, the main control unit 402 determines the length Le of this blank space. In step S504, the main control unit 402 compares the length Le of the blank space with the circumferential length Lr. If the length Le of the blank space is larger than or equal to the circumferential length Lr, in step S505, the main control unit 402 sets the supply bias for the blank space to Rh that corresponds to the toner collection processing, as described using FIG. 5B. Note that, as mentioned above, the supply bias for the blank space means the supply bias to be applied while the toner image is not being formed on the photosensitive member 1 in order to form the blank space on the recording medium. If the length Le of the blank space is smaller than the circumferential length Lr, in step S506, the main control unit 402 determines whether or not an image exists after the blank space. If an image does not exist after the blank space, it is not necessary to worry about a development ghost. Accordingly, in step S507, the main control unit 402 sets the supply bias for the blank space to Rv. On the other hand, if an image exists after the blank space, in step S508, the main control unit 402 compares the density D of the image before the blank space with the threshold value. If the density D is larger than or equal to the threshold value, the toner collection operation does not need to be performed as described using FIG. 6B, and therefore, in step S507, the main control unit 402 sets the supply bias for the blank space to Rv. If the density D is smaller than the threshold value, in step S509, the main control unit 402 obtains the length Ld, the section Ld, and the supply bias Rs for the section Ld using Equation (1), as described using FIG. 6A. In step S510, the main control unit 402 sets the supply bias for the section Ld to Rs, and in step S511, the main control unit 402 sets the supply bias for the blank space to Rh. The processing in FIG. 8 is repeated from the leading end to the trailing end of the recording medium.

Note that the way of obtaining the supply bias to be set for the supply roller 35Y has been described here. The supply biases to be set for the supply rollers 35M, 35C, and 35K for the other colors may also be set to the same bias, with the supply bias to be set for the supply roller 35Y as a reference. Of course a color other than yellow may be used as a reference.

A configuration may also be employed in which the image region and the non-image region are determined for each color. That is to say, a configuration may be employed in which an image to be formed on a recording medium is determined for each color to determine the image region and the non-image region. In this case, the length of the non-image region is different among the colors, and accordingly, the supply biases to be set for the supply rollers 35Y, 35M, 35C, and 35K are independently controlled. That is to say, for example, there can be a situation where the supply biases for the supply rollers 35C and 35K are set to Rv while the supply biases for the supply rollers 35Y and 35M are set to Rh. Note that, in the configuration where the determination is performed for each color, a region where an electrostatic latent image is formed on the photosensitive member 1 in the rotation direction of the photosensitive member 1 is the image region, and a region where an electrostatic latent image is not formed between two image regions is the non-image region. The main control unit 402 controls the supply bias to be applied while the non-image region is passing through the region where the photosensitive member 1 faces the development roller 3, in accordance with the length of the non-image region in the rotation direction of the photosensitive member 1.

Note that the lower the toner density of the image after a blank space is, the less remarkable a development ghost is. Accordingly, a configuration is also possible in which the supply bias is changed in accordance with the toner density of the image after the blank space.

As described above, the supply bias is controlled while an image is being formed on a recording medium, in accordance with the toner density of an image to be formed on the recording medium and the length of a blank space. With this configuration, even in the case where a blank space and an image are mixed within a recording medium, generation of a development ghost can be suppressed.

Second Embodiment

The present embodiment will be described below, mainly regarding a difference from the first embodiment. The first embodiment has disclosed the method for controlling the supply bias in accordance with the lengths of the image region and the non-image region in a single recording medium in the conveyance direction. The present embodiment will disclose a method for controlling the supply bias between recording mediums. A description will be given below of the setting of supply biases for the recording medium #1 and the recording medium #2 that is to be subjected to image formation subsequently to the recording medium #1. It is assumed that the sheet interval between the recording medium #1 and the recording medium #2 is a sheet interval Li, which serves as a predetermined reference value. It is also assumed that an image located on the most rearward side of the recording medium #1 is an image A, and an image located on the most forward side on the recording medium #2 is an image B.

Figure 9A:
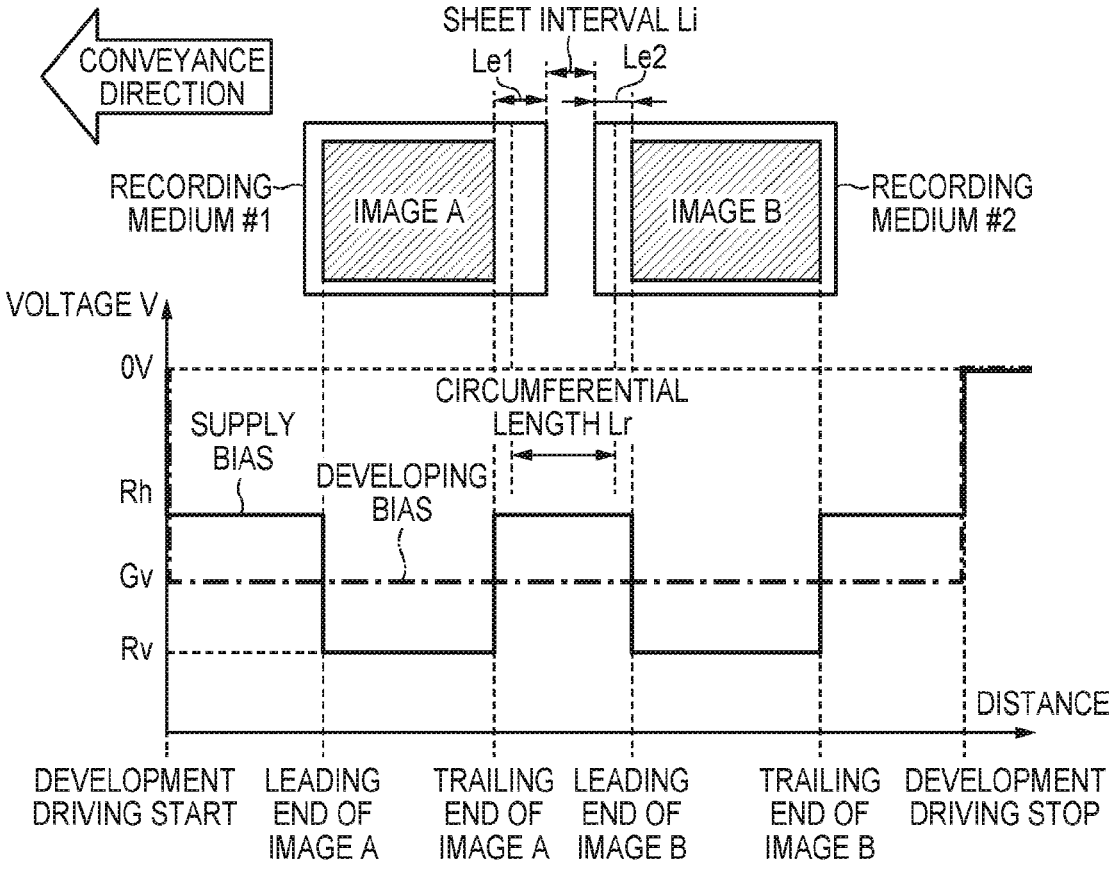
FIGS. 9A and 9B are illustrative diagrams of the bias control according to an embodiment.

FIG. 9A shows the case where a blank space having a length Le1 exists on the rear end side of the recording medium #1, a blank space having a length Le2 exists on the leading end side of the recording medium #2, and the sum of the length Le1, the sheet interval Li, and the length Le2 is larger than or equal to the circumferential length Lr of the development roller 3. In this case, as shown in FIG. 9A, the supply bias is set to Rh from the start of the blank space on the trailing end side of the recording medium #1 to the end of the blank space on the leading end side of the recording medium #2 to execute the toner collection processing.

Figure 9B:
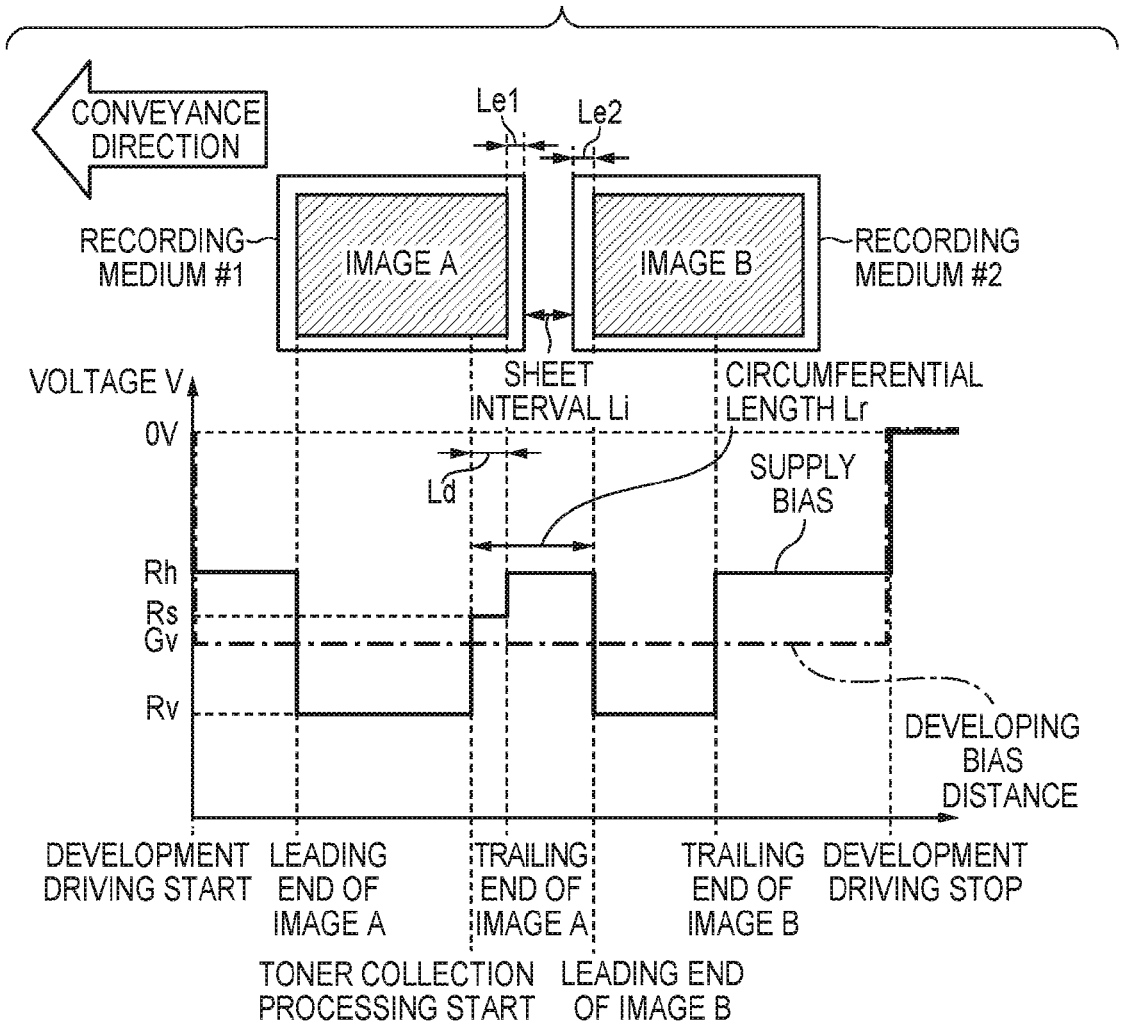

FIG. 9B shows the case where the sum of the length Le1, the sheet interval Li, and the length Le2 is smaller than the circumferential length Lr of the development roller 3, and the density D of the image A located immediately before the start of the blank space on the recording medium #1 is smaller than the threshold value. In this case, the main control unit 402 obtains a length Ld by subtracting the sum of the length Le1, the sheet interval Li, and the length Le2 from the circumferential length Lr, and sets a section that extends from the trailing end of the image A in the direction toward the leading end and has the length Ld as the section Ld. The main control unit 402 obtains the supply bias Rs for the section Ld using Equation (1), based on the density in the section Ld. As shown in FIG. 9B, the supply bias is set to Rs in the section Ld, and the supply bias is set to Rh from the trailing end of the image A on the recording medium #1 to the leading end of the image B on the recording medium #2.

Figure 10:
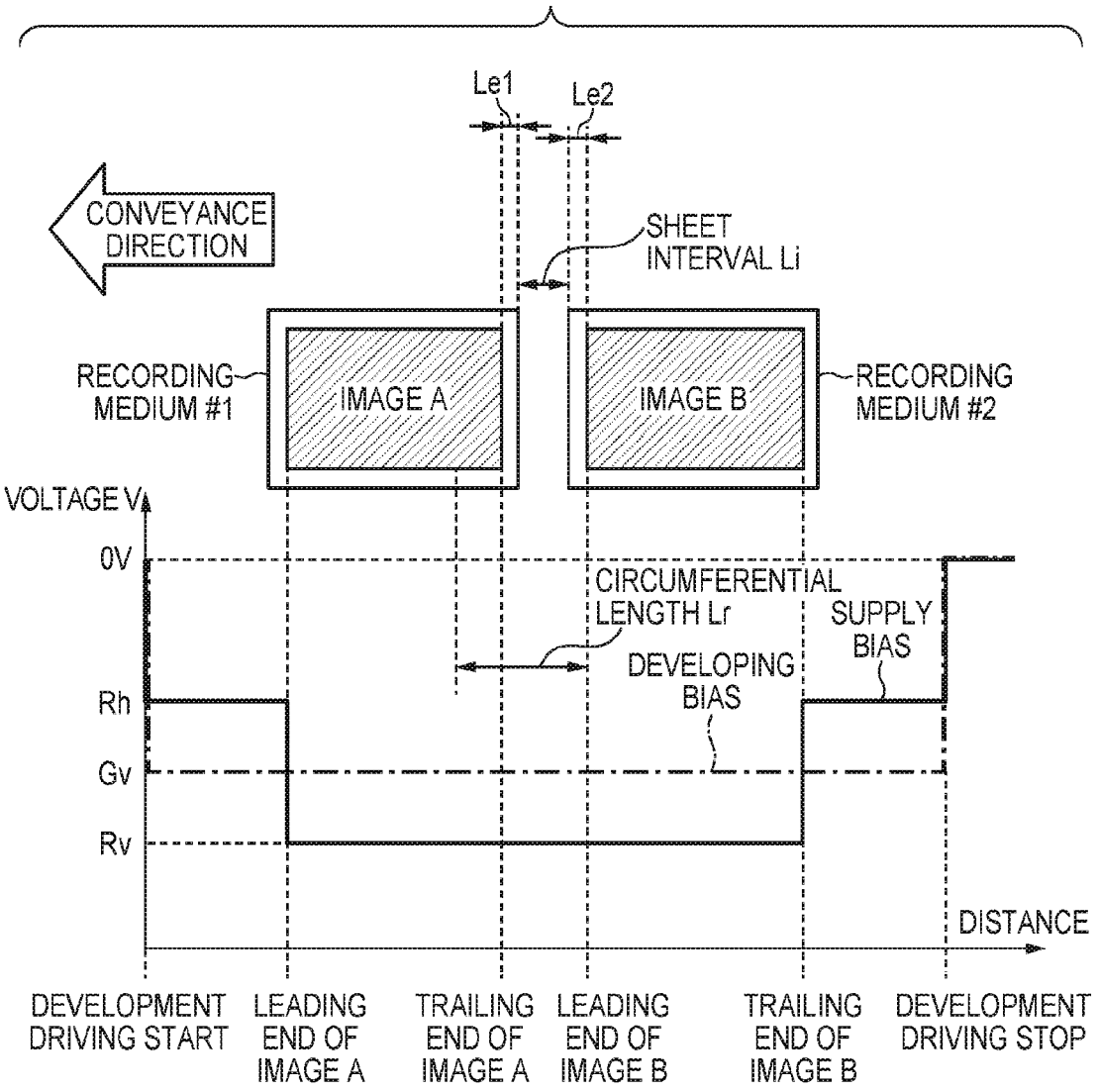
FIG. 10 is an illustrative diagram of the bias control according to an embodiment.

FIG. 10 shows the case where the sum of the length Le1, the sheet interval Li, and the length Le2 is smaller than the circumferential length Lr of the development roller 3, and the density D of the image A located immediately before the start of the blank space region on the recording medium #1 is larger than or equal to the threshold value. In this case, as shown in FIG. 10, the toner collection operation is not performed, and accordingly, the supply bias is set to Rv for the blank space and the sheet interval.

Figure 11:
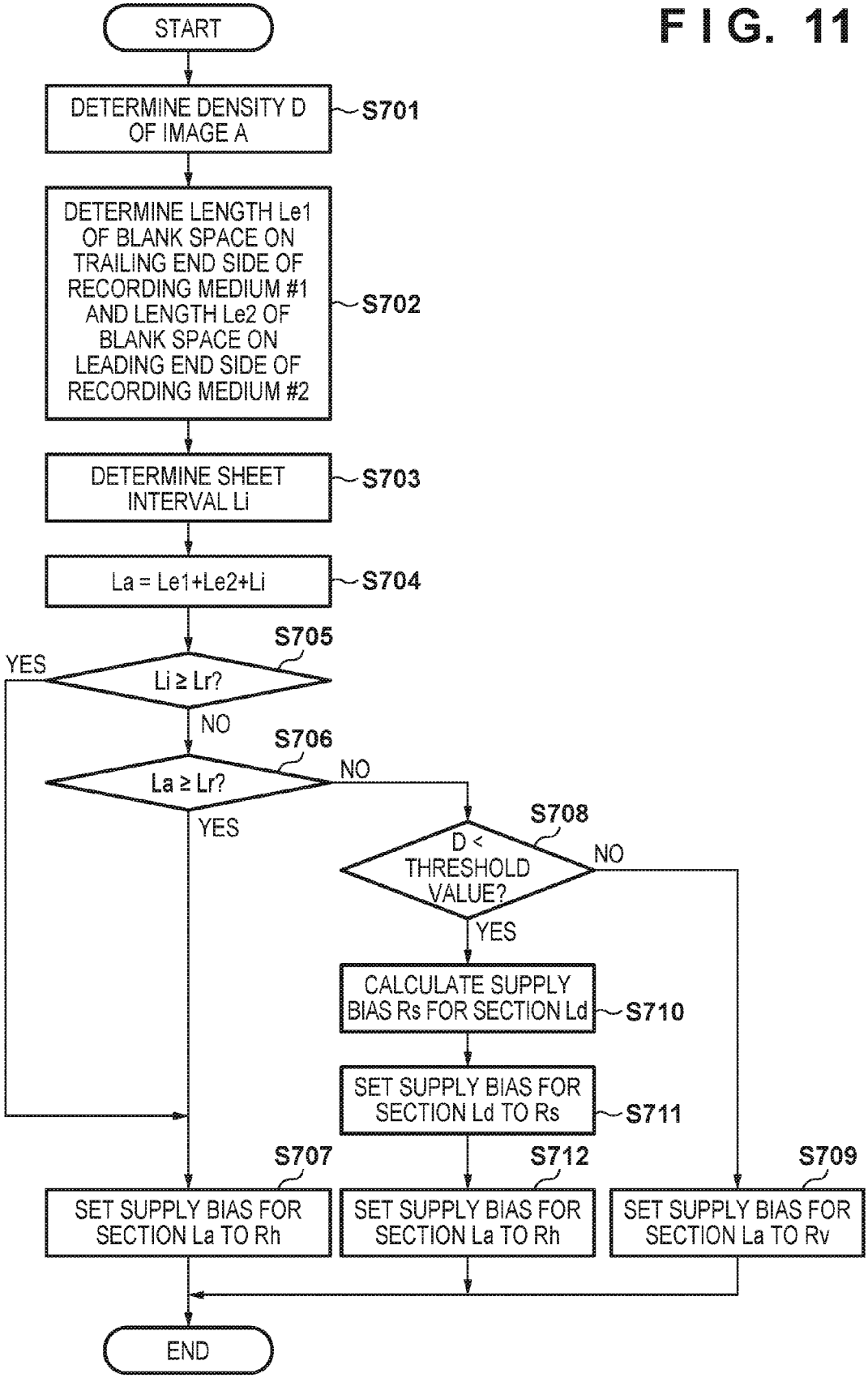
FIG. 11 is a flowchart of the bias control according to an embodiment.

FIG. 11 is a flowchart of the processing in the main control unit 402 according to the present embodiment. In step S701, the main control unit 402 determines the density D of the image A, and, in step S702, the main control unit 402 determines the length Le1 of the blank space on the trailing end side of the recording medium #1 and the length Le2 of the blank space on the leading end side of the recording medium #2. In step S703, the main control unit 402 determines the sheet interval Li, and in step S704, the main control unit 402 obtains La, which is the sum of the length Le1, the sheet interval Li, and the length Le2. It is also assumed that a section from the trailing end of the image A to the leading end of the image B is a section La. In step S705, the main control unit 402 compares the sheet interval Li with the circumferential length Lr. If the sheet interval Li is larger than or equal to the circumferential length Lr, in step S707, the main control unit 402 sets the supply bias to Rh in order to execute the toner collection processing in the section La, as shown in FIG. 9A. On the other hand, if the sheet interval Li is smaller than the circumferential length Lr, in step S706, the main control unit 402 compares the length La with the circumferential length Lr. If the length La is larger than or equal to the circumferential length Lr, in step S707, the main control unit 402 sets the supply bias for the section La to Rh. On the other hand, if the length La is smaller than the circumferential length Lr, in step S708, the main control unit 402 compares the density D with the threshold value. If the density D is larger than or equal to the threshold value, the main control unit 402 does not perform the toner collection processing in the section La, as described using FIG. 10. Accordingly, in step S709, the main control unit 402 sets the supply bias for the section La to Rv. On the other hand, if the density D is smaller than the threshold value, in step S710, the main control unit 402 obtains the length Ld and the section Ld, as described using FIG. 9B, and calculates the supply bias Rs for the section Ld using Equation (1). In step S711, the main control unit 402 sets the supply bias for the section Ld to Rs, and in step S712, the main control unit 402 sets the supply bias for the section La to Rh.

As described above, the supply bias is controlled based on the sheet interval between successive recording mediums, the length of a blank space on the trailing end side of a leading recording medium, and the length of a blank space on the leading end side of a following recording medium. This configuration enables generation of a development ghost to be suppressed. Note that an image is not formed in the sheet interval. That is to say, the present embodiment is the same as the first embodiment except that the blank space on the trailing end side of the leading recording medium, the blank space on the leading end side of the following recording medium, and the sheet interval are collectively deemed to be a single non-image region.

Third Embodiment

Figure 12A:
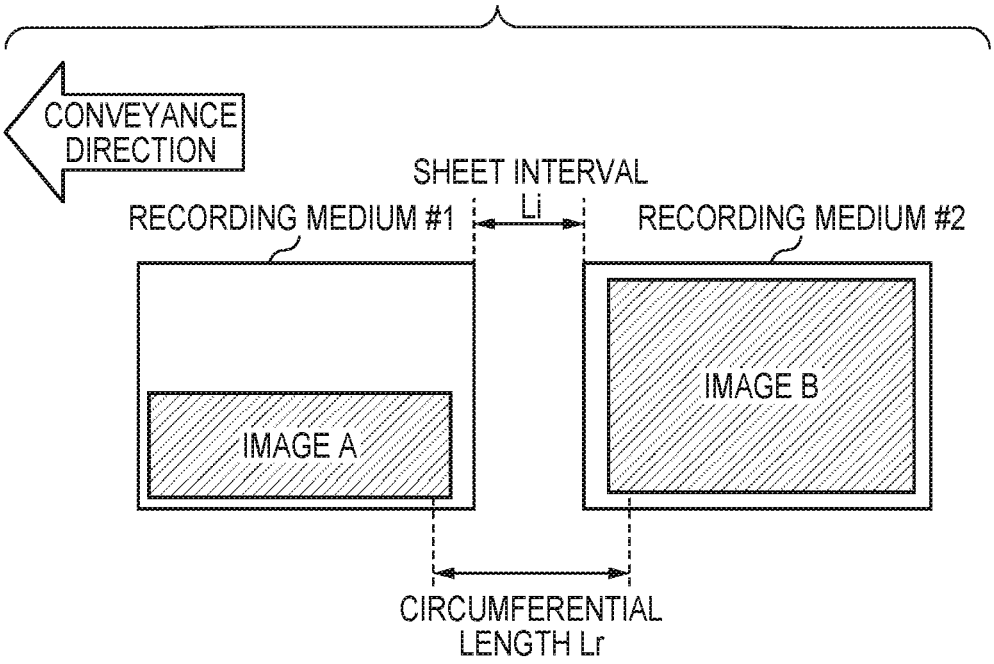
FIGS. 12A and 12B are illustrative diagrams of the bias control according to an embodiment.
Figure 12B:
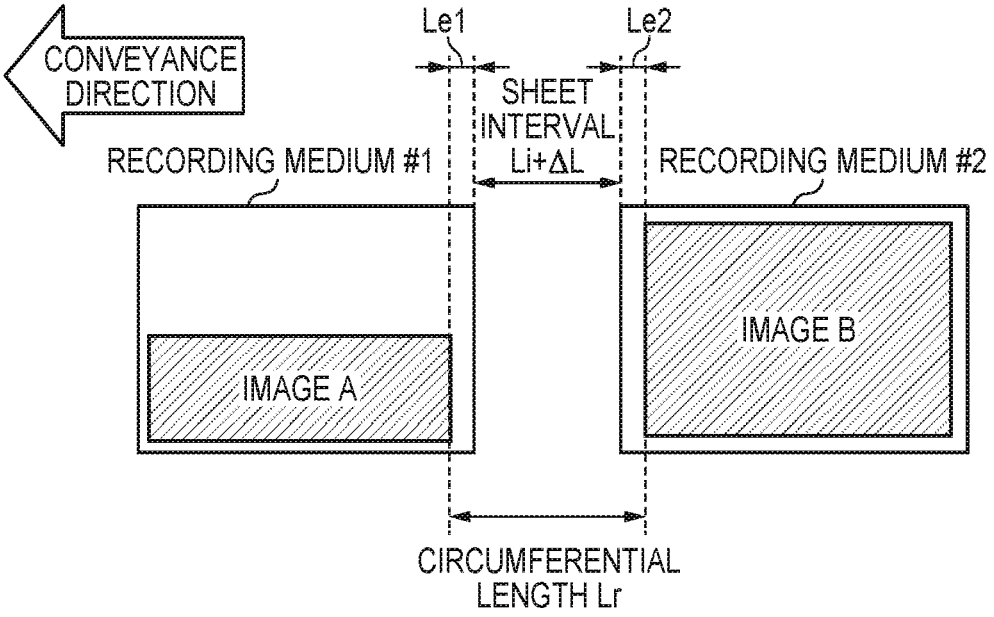

Subsequently, the present embodiment will be described, mainly regarding a difference from the second embodiment. In the case where an image is formed only in the left half when viewed in the conveyance direction, and the right half is a blank space as in a recording medium #1 in FIG. 12A, if the toner collection processing is performed on the image and the blank space, the density of the image A may possibly change, resulting in a decrease in image quality. In the present embodiment, image quality is given priority, and the sheet interval between recording mediums is widened by ΔL from Li, which is a reference value, as shown in FIG. 12B, in accordance with the toner density.

Figure 13:
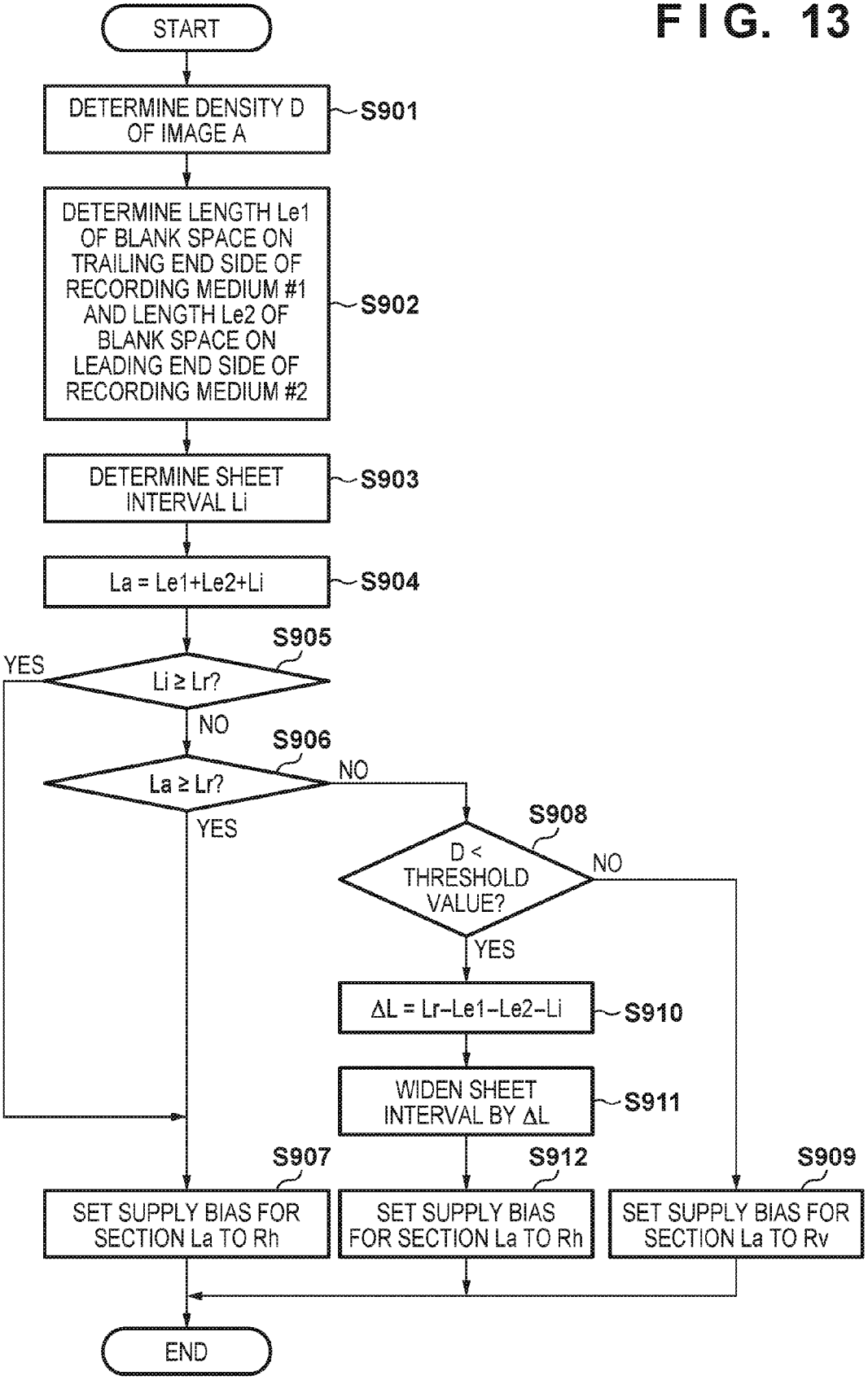
FIG. 13 is a flowchart of the bias control according to an embodiment.

FIG. 13 is a flowchart of the processing in the main control unit 402 according to the present embodiment. The processing in steps S901 to S909 in FIG. 13 is the same as the processing in steps S701 to S709 in FIG. 11. In the present embodiment, if the density D is smaller than the threshold value in step S908, the sheet interval control unit 408 in the main control unit 402 obtains, as ΔL, a value that is obtained by subtracting the lengths Le1, Li, and Le2 from the circumferential length Lr, and widens the sheet interval from Li by ΔL in step S911, unlike in the second embodiment. Then, the supply bias control unit 407 in the main control unit 402 sets the supply bias for the section La after widening the sheet interval to Rh and executes the toner collection processing.

Fourth Embodiment

Figure 14A:
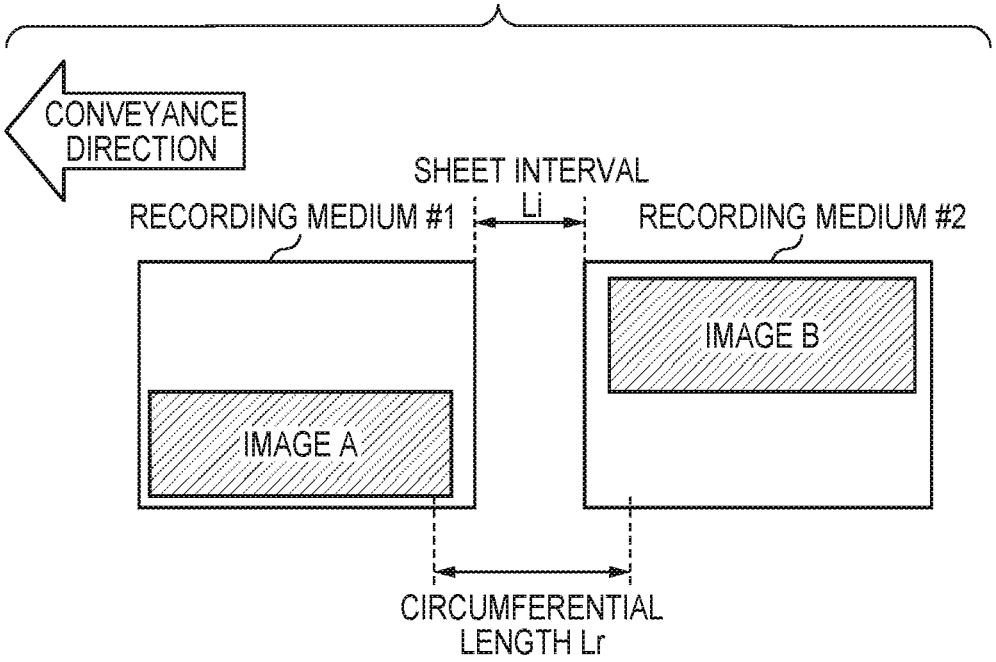
FIGS. 14A and 14B are illustrative diagrams of the bias control according to an embodiment.
Figure 14B:
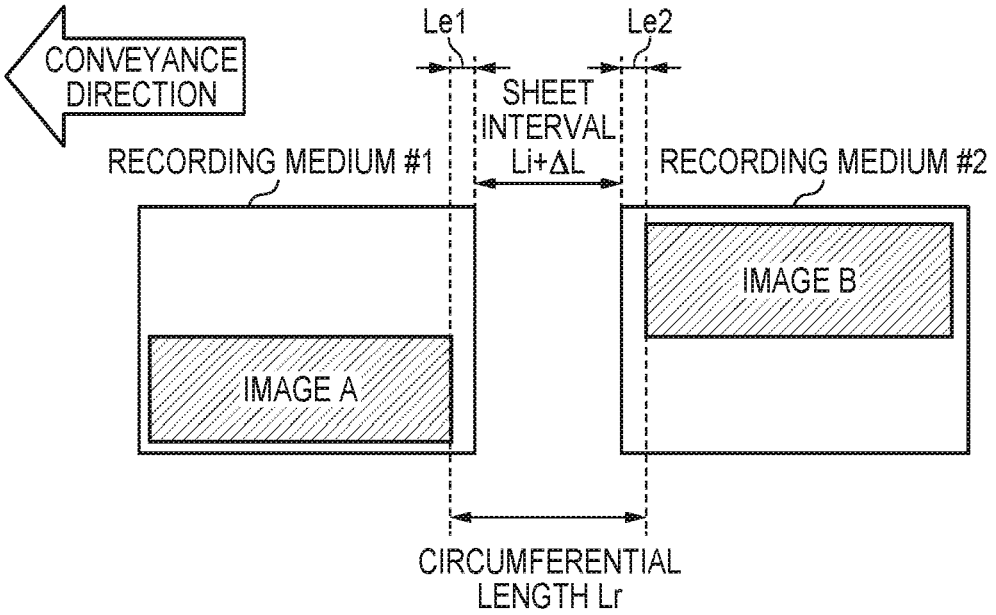

Subsequently, the present embodiment will be described, mainly regarding a difference from the second embodiment. Consider the case where in a leading recording medium #1, an image A whose density is larger than or equal to the threshold value is formed in the left half with respect to the conveyance direction, and in a following recording medium #2, an image B whose density is larger than or equal to the threshold value is formed in the right half with respect to the conveyance direction, as shown in FIG. 14A. In this case, if the toner collection processing is performed on the images and the blank space, the density of either the image A or the image B or the density of both images may possibly change, resulting in a decrease in image quality. In the present embodiment, image quality is given priority, and the sheet interval between recording mediums is widened by ΔL as shown in FIG. 14B, in accordance with the density of the images.

Figure 15:
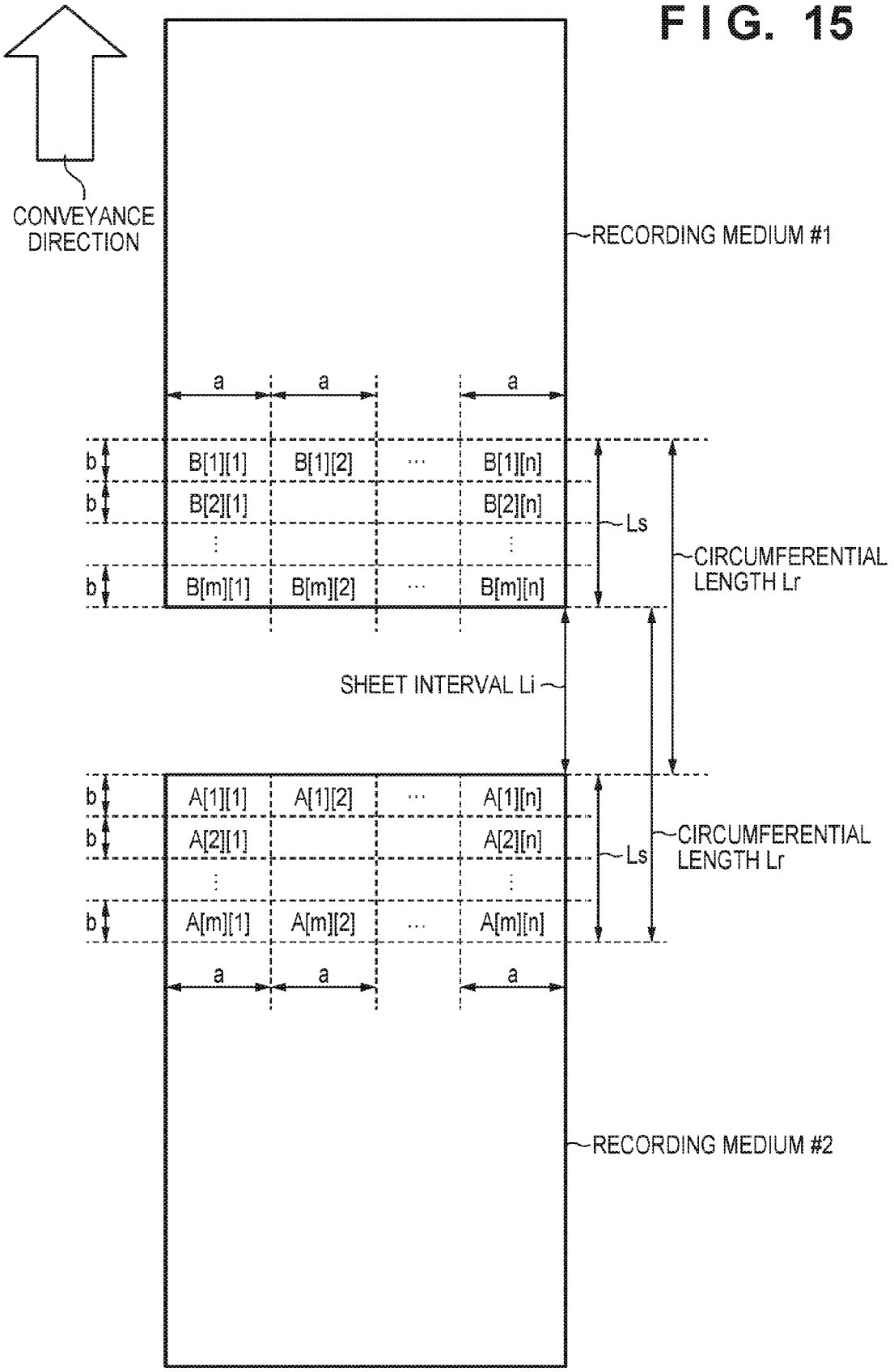
FIG. 15 is an illustrative diagram of the bias control according to an embodiment.

In the present embodiment, as shown in FIG. 15, the length obtained by subtracting the sheet interval Li from the circumferential length Lr is defined as Ls. Of the recording medium #1, a portion that extends from the trailing end in the direction toward the leading end and has the length Ls is defined as a trailing end portion, and of the recording medium #2, a portion that extends from the leading end in the direction toward the trailing end and has the length Ls is defined as a leading end portion. The trailing end portion is divided into n×m regions B[1][1] to B[m][n]. The leading end portion is also divided into n×m regions A[1][1] to A[m][n]. In the present embodiment, the trailing end portion and the leading end portion are each divided in the conveyance direction into m portions each having a length b, and divided in the length perpendicular to the conveyance direction into n portions each having a length a. In the present embodiment, the region B[i][j] and the region A[i][j] (i is an integer of 1 to m, and j is an integer of 1 to n) have the same size, but the size of the regions may be different.

In the present embodiment, the main control unit 402 determines the density Db[i][j] of each region B[i][j] on the front side in the conveyance direction with respect to the non-image region, and the density Da[i][j] of each region A[i][j] on the rear side. Then, the main control unit 402 determines the lowest density and the highest density in the density Db[i][1] to the density Db[i][n]. That is to say, the change in the density in the direction perpendicular to the conveyance direction (hereinafter referred to as a "perpendicular direction") is determined. If the highest density is larger than or equal to the threshold value and the lowest density is smaller than the threshold value, the density in the perpendicular direction is not uniform, and a density change that crosses the threshold value exists. That is to say, there is a possibility that the image to be formed on the recording medium #1 is as shown in FIG. 14A. In this case, the main control unit 402 determines the lowest density and the highest density in the density Da[i][1] to the density Da[i][n]. If the highest density is larger than or equal to the threshold value and the lowest density is smaller than the threshold value, the density in the perpendicular direction is not uniform, and a density change that crosses the threshold value exists. That is to say, there is a possibility that the image to be formed on the recording medium #2 is as shown in FIG. 14A. In this case, the sheet interval control unit 408 widens the sheet interval as shown in FIG. 14B.

Figure 16:
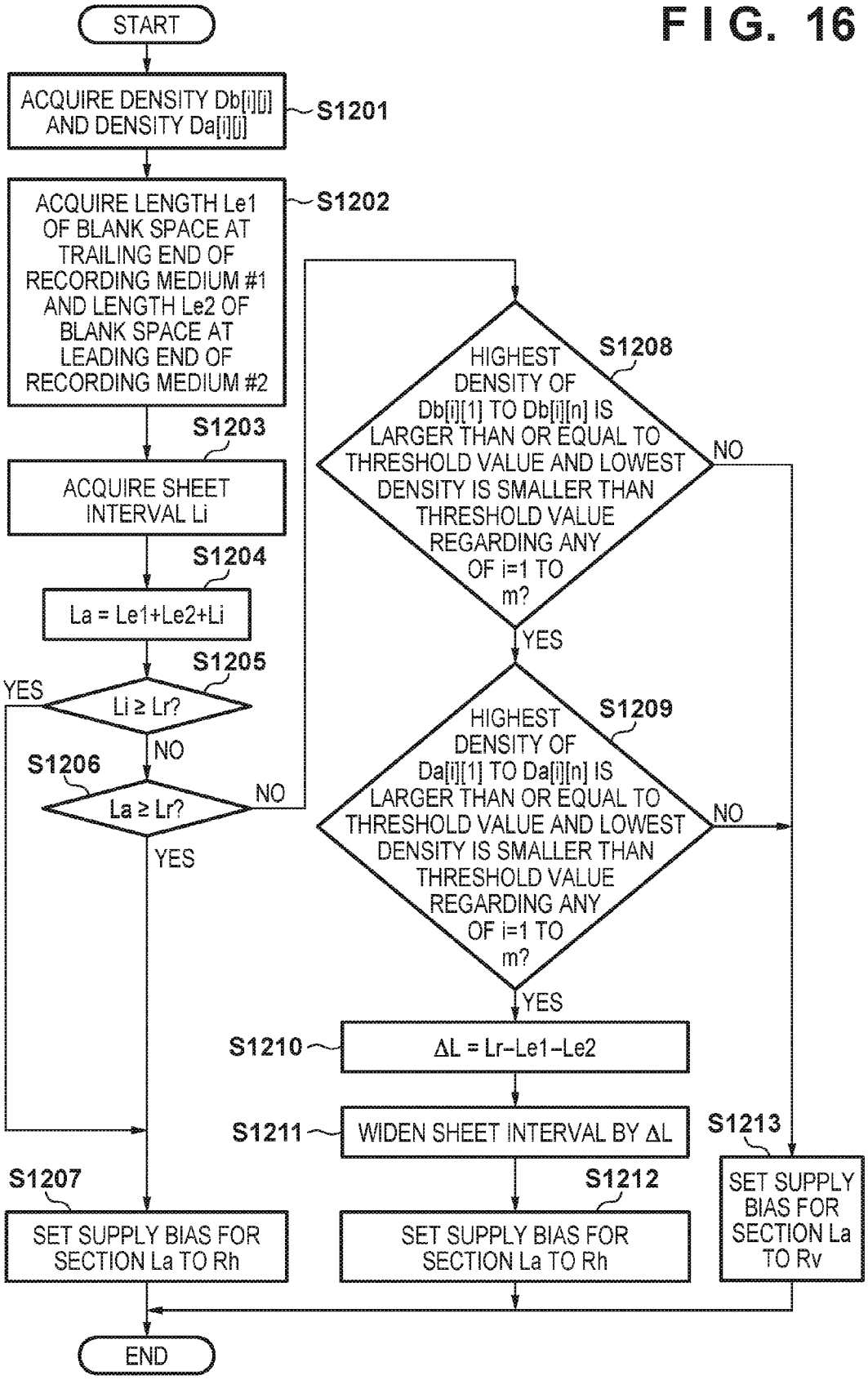
FIG. 16 is a flowchart of the bias control according to an embodiment.

FIG. 16 is a flowchart of the processing in the main control unit 402 according to the present embodiment. In step S1201, the main control unit 402 acquires the density Db[i][j] and the density Da[i][j], then in step S1202, the main control unit 402 acquires the length Le1 of the blank space at the trailing end of the recording medium #1 and the length Le2 of the blank space at the leading end of the recording medium #2, and in step S1203, the main control unit 402 acquires the sheet interval Li. In step S1204, the main control unit 402 obtains the sum La of the length Le1 of the blank space, the sheet interval Li, and the length Le2 of the blank space. The main control unit 402 also defines a section from the start of the blank space at the trailing end of the recording medium #1 to the end of the blank space at the leading end of the recording medium #2 as a section La. In step S1205, the main control unit 402 compares the sheet interval Li with the circumferential length Lr. If the sheet interval Li is larger than or equal to the circumferential length Lr, in step S1207, the main control unit 402 sets the supply bias for the section La to Rh. On the other hand, if the sheet interval Li is smaller than the circumferential length Lr, in step S1206, the main control unit 402 compares the length La with the circumferential length Lr. If the length La is larger than or equal to the circumferential length Lr, in step S1207, the main control unit 402 sets the supply bias for the section La to Rh.

On the other hand, if the length La is smaller than the circumferential length Lr, in step S1208, the main control unit 402 determines whether the threshold value is between the lowest density and the highest density in the density Db[i][1] to the density Db[i][n] when i is any of 1 to m. If the threshold value is not between the lowest density and the highest density, in step S1213, the main control unit 402 sets the supply bias for the section La to Rv. On the other hand, if the threshold value is between the lowest density and the highest density, in S1209, the main control unit 402 determines whether the threshold value is between the lowest density and the highest density in the density Da[i][1] to the density Da[i][n] when i is any of 1 to m. If the threshold value is not between the lowest density and the highest density, in step S1213, the main control unit 402 sets the supply bias for the section La to Rv. On the other hand, if the threshold value is between the highest density and the lowest density, there is a possibility of the state shown in FIG. 14A. Accordingly, in step S1210, the main control unit 402 obtains a value ΔL, which is a value obtained by subtracting the lengths Le1, Li, and Le2 from the circumferential length Lr, and in step S1211, the main control unit 402 widens the sheet interval between the recording medium #1 and the recording medium #2 by ΔL. In step S1212, the main control unit 402 sets the supply bias for the section La to Rh.

As described, even in the case where the image density changes in the direction perpendicular to the recording medium conveyance direction, generation of a development ghost can be suppressed.

Other Embodiments

Note that in the above embodiments, the image region and the non-image region including a sheet interval are determined and the supply bias is controlled for an image of each color that is to be formed on recording mediums. However, the image region and the non-image region can also be determined based on an image obtained by overlaying images of Y, M, C, and K that are used in image formation, for example. In this case, only the image to be subjected to the determination is different, and the way of determining the supply bias is the same as in the above embodiments. The supply biases that are to be set for the supply rollers 35Y, 35M, 35C, and 35K are also the same.

Although the above embodiments have been described based on the length of the non-image region, since the time is obtained from the speed and the distance (length) of conveyance of recording mediums, the control for setting the supply bias that is performed by the main control unit 402 can also be defined as the timing thereof.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-045086, filed on Mar. 6, 2015, which is hereby incorporated by reference herein in its entirety.

What is claimed is:

1. An image forming apparatus comprising:

an image carrier configured to be driven to rotate and on which an electrostatic latent image is to be formed;

a development unit configured to develop, using a developer, the electrostatic latent image formed on the image carrier and form a developer image in a region where the image carrier faces the development unit;

a supply unit configured to output a supply bias, supply the developer to the development unit, and collect the developer from the development unit;

a reception unit configured to receive image data;

an analysis unit configured to analyze a non-image region where the developer image is not formed from the image data; and a control unit configured to control the supply bias in accordance with a length of the non-image region where the developer image is not formed in a rotation direction of the image carrier, wherein the control unit is further configured to control, if the length of the non-image region is longer than or equal to a predetermined length, the supply bias so as to collect the developer from the development unit during a time period from a timing that is a predetermined time period earlier than when a position of the image carrier corresponding to the non-image region starts to pass through the region where the image carrier faces the development unit to a timing that is the predetermined time period earlier than when the position of the image carrier corresponding to the non-image region finishes passing through the region where the image carrier faces the development unit, the development unit is a development roller, and the predetermined length is a circumferential length of the development roller.

2. The image forming apparatus according to claim 1, wherein the non-image region is a region including a region where the developer image is not formed on a recording medium and a region of an interval between successive recording mediums.

3. The image forming apparatus according to claim 1, wherein the control unit is further configured to control, if the length of the non-image region is shorter than the predetermined length and a density of the developer image in an image region where the developer image is formed, the image region being located frontward of the non-image region in the rotation direction, is higher than a threshold value, the supply bias so as to supply the developer to the development unit during the time period from the timing that is the predetermined time period earlier than when the position of the image carrier corresponding to the non-image region starts to pass through the region where the image carrier faces the development unit to the timing that is the predetermined time period earlier than when the position of the image carrier corresponding to the non-image region finishes passing through the region where the image carrier faces the development unit.

4. The image forming apparatus according to claim 1, wherein the control unit is further configured to control, if the length of the non-image region is shorter than the predetermined length and a density of the developer image in an image region where the developer image is formed, the image region being located frontward of the non-image region in the rotation direction, is lower than a threshold value, the supply bias so as to collect the developer from the development unit in time periods from timings that are a predetermined time period earlier than when a position of the image carrier corresponding to a trailing end portion of the image region located forward of the non-image region in the rotation direction and the position of the image carrier corresponding to the non-image region start to pass through the region where the image carrier faces the development unit to timings that are the predetermined time period earlier than when the position of the image carrier corresponding to the trailing end portion of the image region located forward of the non-image region in the rotation direction and the position of the image carrier corresponding to the non-image region finish passing through the region where the image carrier faces the development unit, and the control unit is further configured to determine the length of the trailing end portion in the rotation direction in accordance with the predetermined length and the length of the non-image region.

5. The image forming apparatus according to claim 4, wherein the control unit is further configured to determine the length of the trailing end portion by subtracting the length of the non-image region from the predetermined length.

6. The image forming apparatus according to claim 4, wherein the control unit is further configured to perform control such that the supply bias during the time period from the timing that is the predetermined time period earlier than when the position of the image carrier corresponding to the trailing end portion starts to pass through the region where the image carrier faces the development unit to the timing that is the predetermined time period earlier than when the position of the image carrier corresponding to the trailing end portion finishes passing through the region where the image carrier faces the development unit is lower than the supply bias during the time period from the timing that is the predetermined time period earlier than when the position of the image carrier corresponding to the non-image region starts to pass through the region where the image carrier faces the development unit to the timing that is the predetermined time period earlier than when the position of the image carrier corresponding to the non-image region finishes passing through the region where the image carrier faces the development unit.

7. The image forming apparatus according to claim 1, wherein the non-image region is a region in a single recording medium.

8. The image forming apparatus according to claim 1, wherein the non-image region is a region that spans between a leading recording medium and a following recording medium.

9. The image forming apparatus according to claim 1, wherein the non-image region is a region that spans between a leading recording medium and a following recording medium, and the control unit is further configured to make an interval between the leading recording medium and the following recording medium wider than a reference value if the length of the non-image region is shorter than the predetermined length and a density of the developer image in an image region where the developer image located forward of the non-image region in the rotation direction is formed is lower than a threshold value.

10. The image forming apparatus according to claim 1, wherein the non-image region is a region that spans between a leading recording medium and a following recording medium, and the control unit is further configured to determine a change in a density of a first developer image in a trailing end portion of an image region where a developer image located forward of the non-image region in the rotation direction is formed, the change being in a perpendicular direction that is perpendicular to the rotation direction, and a change in a density of a second developer image in a leading end portion in an image region where the developer image located rearward of the non-image region in the rotation direction is formed, the change being in the perpendicular direction if the length of the non-image region is shorter than the predetermined length, and to make an interval between the leading recording medium and the following recording medium wider than a reference value if both the change in the density of the first developer image and the change in the density of the second developer image cross a threshold value.

11. The image forming apparatus according to claim 10, wherein the control unit is further configured to determine lengths of the trailing end portion and the leading end portion in the rotation direction based on the predetermined length and the reference value.

12. The image forming apparatus according to claim 9, wherein the control unit is further configured to widen the interval between the leading recording medium and the following recording medium such that a length of the non-image region in the rotation direction is longer than or equal to the predetermined length.

13. The image forming apparatus according to claim 9, wherein the control unit is further configured to control the supply bias so as to collect the developer from the development unit during the time period from the timing that is the predetermined time period earlier than when the position of the image carrier corresponding to the non-image region after widening the interval between the leading recording medium and the following recording medium starts to pass through the region where the image carrier faces the development unit to the timing that is the predetermined time period earlier than when the position of the image carrier corresponding to the non-image region after widening the interval between the leading recording medium and the following recording medium finishes passing through the region where the image carrier faces the development unit.

14. The image forming apparatus according to claim 1, wherein the control unit is further configured to determine an image region where the developer image is formed and the non-image region based on an image to be formed on a recording medium.

15. The image forming apparatus according to claim 1, wherein the image carrier, the development unit, and the supply unit are provided so as to correspond to each color to be used in image formation, and the control unit is further configured to determine an image region where the developer image is formed and the non-image region for each color of an image to be formed on a recording medium, and independently set the supply bias for each supply unit.

16. The image forming apparatus according to claim 1, wherein the predetermined time period is obtained by dividing a distance in the rotation direction of the development unit from a nip portion between the development unit and the supply unit to a nip portion between the development unit and the image carrier by a rotation speed of the development unit.

17. An image forming apparatus comprising:

an image carrier configured to be driven to rotate and on which an electrostatic latent image is to be formed;

a development unit configured to develop, using a developer, the electrostatic latent image formed on the image carrier and form a developer image in a region where the image carrier faces the development unit;

a supply unit configured to output a supply bias, supply the developer to the development unit, and collect the developer from the development unit; and a control unit configured to control the supply bias in a region in a single recording medium based on a length of a non-image region where the developer image is not formed in a rotation direction of the image carrier.

18. An image forming apparatus comprising:

an image carrier configured to be driven to rotate and on which an electrostatic latent image is to be formed;

a development unit configured to develop, using a developer, the electrostatic latent image formed on the image carrier and form a developer image in a region where the image carrier faces the development unit;

a supply unit configured to output a supply bias, supply the developer to the development unit, and collect the developer from the development unit; and a control unit configured to control the supply bias based on a length of a non-image region where the developer image is not formed in a rotation direction of the image carrier, wherein the control unit is further configured to widen an interval between successive recording mediums to control the supply bias if control of the supply bias cannot be performed in a region of the interval between the successive recording mediums.

19. An image forming apparatus comprising:

an image carrier configured to be driven to rotate and on which an electrostatic latent image is to be formed;

a development unit configured to develop, using a developer, the electrostatic latent image formed on the image carrier and form a developer image in a region where the image carrier faces the development unit;

a supply unit configured to output a supply bias, supply the developer to the development unit, and collect the developer from the development unit;

a reception unit configured to receive image data;

an analysis unit configured to analyze a non-image region where the developer image is not formed from the image data, the non-image region including a sheet interval between a first recording medium and a second recording medium subsequent to the first recording medium; and a control unit configured to control the supply bias in accordance with a length of the non-image region where the developer image is not formed in a rotation direction of the image carrier, wherein the developer is collected from the development unit when the length of the non-image region is equal to or longer than a circumferential length of the development unit, and the developer is supplied to the development unit when the length of the non-image region is shorter than the circumferential length of the development unit.

* * * * *